US008562184B2

(12) United States Patent
Klipstein et al.

(10) Patent No.: US 8,562,184 B2
(45) Date of Patent: Oct. 22, 2013

(54) LED WORK LIGHT

(75) Inventors: Donald L. Klipstein, Upper Darby, PA (US); Jack Brass, Toronto (CA); Robert Tod Whitfield, Toronto (CA)

(73) Assignee: Brasscorp Limited, North York (CA)

( * ) Notice: Subject to any disclaimer, the term of this patent is extended or adjusted under 35 U.S.C. 154(b) by 174 days.

(21) Appl. No.: 12/289,782

(22) Filed: Nov. 4, 2008

(65) Prior Publication Data

US 2009/0147519 A1 Jun. 11, 2009

Related U.S. Application Data

(63) Continuation of application No. PCT/CA2007/000802, filed on May 4, 2007, and a continuation-in-part of application No. 11/083,086, filed on Mar. 18, 2005, now Pat. No. 7,553,051.

(60) Provisional application No. 60/797,480, filed on May 4, 2006, provisional application No. 60/815,336, filed on Jun. 21, 2006, provisional application No. 60/818,426, filed on Jul. 3, 2006, provisional application No. 60/843,647, filed on Sep. 11, 2006, provisional application No. 60/855,357, filed on Oct. 30, 2006, provisional application No. 60/521,240, filed on Mar. 18, 2004, provisional application No. 60/521,680, filed on Jun. 16, 2004, provisional application No. 60/521,689, filed on Jun. 17, 2004, provisional application No. 60/521,738, filed on Jun. 28, 2004, provisional application No. 60/521,888, filed on Jul. 17, 2004.

(51) Int. Cl.
*F21L 4/02* (2006.01)

(52) U.S. Cl.
USPC ..... 362/373; 362/249.02; 362/249.03; 362/249.07; 362/451

(58) Field of Classification Search
USPC ..... 362/373, 218, 249.02, 249.03, 249.07, 362/311.02, 451
See application file for complete search history.

(56) References Cited

U.S. PATENT DOCUMENTS

| | | | |
|---|---|---|---|
| 1,507,742 | A | 9/1924 | Kollath |
| 2,469,080 | A | 5/1949 | Rosin |

(Continued)

FOREIGN PATENT DOCUMENTS

| | | |
|---|---|---|
| CA | 2501447 | 9/2005 |
| WO | 2006/102757 | 10/2006 |

OTHER PUBLICATIONS

Office Action dated Jan. 19, 2011 for U.S. Appl. No. 12/003,322.

(Continued)

*Primary Examiner* — Sharon Payne

(57) ABSTRACT

An LED work light has multichip LEDs and a diffusing dome. Each LED may have separate electrical terminals for each chip. The LED work light may have convex lenses forward of each LED. Convex lenses may be hemispherical. Convex lenses may have a nonhemispheric curved surface whose cross section has at least one circular arc and no non-circular arcs. The LED work light has a battery or receives power from an external power source. The LED work light may have a transparent plastic tube as a structural member. A replaceable plastic cover may be added to protect any structural tube or other major transparent part of the LED work light from abrasions. The plastic cover may be tubular. The plastic cover may comprise laminations of plastic that can be removed individually after being abraded. Any external power source may be a wall transformer type and may have current limiting means. The LEDs may be attached to the rear surface of an LED PCB that is fastened to a heatsink in a manner achieving thermal contact between the rear surfaces of the LEDs and the heatsink. A position sensing switch may be used.

9 Claims, 20 Drawing Sheets

(56) References Cited

U.S. PATENT DOCUMENTS

| | | | | |
|---|---|---|---|---|
| 3,379,869 | A | 4/1968 | Dorman | |
| D215,751 | S | 10/1969 | Castellano | |
| 3,516,087 | A * | 6/1970 | Rueger | 340/815.51 |
| 3,676,668 | A | 7/1972 | Collins | |
| 3,790,912 | A | 2/1974 | Murphy | |
| 3,808,434 | A | 4/1974 | Gutbier | |
| 4,013,915 | A | 3/1977 | Dufft | |
| 4,185,891 | A | 1/1980 | Kaestner | |
| 4,477,863 | A | 10/1984 | Walz | |
| 4,729,076 | A * | 3/1988 | Masami et al. | 362/235 |
| 4,826,269 | A | 5/1989 | Streifer et al. | |
| 4,935,665 | A | 6/1990 | Murata | |
| 4,963,798 | A | 10/1990 | McDermott | |
| 5,092,331 | A | 3/1992 | Nakamura et al. | |
| 5,289,082 | A | 2/1994 | Komoto | |
| D349,123 | S | 7/1994 | Cooley et al. | |
| 5,410,453 | A | 4/1995 | Ruskouski | |
| 5,528,477 | A | 6/1996 | Carmo | |
| 5,749,830 | A | 5/1998 | Kaneko et al. | |
| 5,757,557 | A | 5/1998 | Medvedev et al. | |
| 5,785,404 | A | 7/1998 | Wiese | |
| 5,806,961 | A | 9/1998 | Dalton et al. | |
| 5,954,206 | A | 9/1999 | Mallon et al. | |
| 5,975,712 | A | 11/1999 | Shiao | |
| 5,984,861 | A | 11/1999 | Crowley | |
| 6,095,661 | A | 8/2000 | Lebens et al. | |
| 6,132,072 | A | 10/2000 | Turnbull | |
| 6,142,650 | A | 11/2000 | Brown et al. | |
| D434,868 | S | 12/2000 | Trigiani | |
| 6,165,384 | A | 12/2000 | Cooper et al. | |
| 6,183,086 | B1 | 2/2001 | Neubert | |
| 6,190,020 | B1 | 2/2001 | Hartley | |
| 6,200,134 | B1 | 3/2001 | Kovac et al. | |
| 6,250,771 | B1 | 6/2001 | Sharrah et al. | |
| 6,305,818 | B1 | 10/2001 | Lebens et al. | |
| 6,357,893 | B1 | 3/2002 | Belliveau | |
| 6,367,949 | B1 | 4/2002 | Pederson | |
| 6,402,347 | B1 | 6/2002 | Maas et al. | |
| 6,468,077 | B1 | 10/2002 | Melikechi et al. | |
| 6,480,389 | B1 | 11/2002 | Shie et al. | |
| 6,485,160 | B1 | 11/2002 | Sommers et al. | |
| 6,491,408 | B1 | 12/2002 | Cooper et al. | |
| 6,501,084 | B1 | 12/2002 | Sakai et al. | |
| 6,511,203 | B1 | 1/2003 | Winther | |
| 6,527,411 | B1 | 3/2003 | Sayers | |
| D472,890 | S | 4/2003 | Suzuki | |
| 6,590,220 | B1 | 7/2003 | Kalley et al. | |
| 6,612,717 | B2 * | 9/2003 | Yen | 362/245 |
| 6,630,682 | B2 | 10/2003 | Shanley et al. | |
| 6,637,923 | B2 | 10/2003 | Amano | |
| D483,508 | S | 12/2003 | Galvez | |
| D483,893 | S | 12/2003 | Galvez | |
| 6,710,363 | B1 | 3/2004 | Trigiani | |
| 6,805,476 | B2 | 10/2004 | Amano | |
| 6,819,505 | B1 | 11/2004 | Cassarley et al. | |
| D502,276 | S | 2/2005 | Kovacik et al. | |
| 6,853,151 | B2 * | 2/2005 | Leong et al. | 315/185 R |
| 6,857,756 | B2 | 2/2005 | Reiff et al. | |
| 6,866,401 | B2 | 3/2005 | Sommers et al. | |
| 6,890,086 | B2 | 5/2005 | Shiu | |
| D509,010 | S | 8/2005 | Kovacik et al. | |
| 6,940,704 | B2 | 9/2005 | Stalions | |
| 6,979,104 | B2 | 12/2005 | Brass et al. | |
| 7,029,150 | B2 | 4/2006 | Finch | |
| 7,083,297 | B2 | 8/2006 | Matthew et al. | |
| 7,145,649 | B2 | 12/2006 | Brass | |
| 7,153,004 | B2 | 12/2006 | Galli | |
| 7,172,319 | B2 | 2/2007 | Holder | |
| 7,214,952 | B2 | 5/2007 | Klipstein et al. | |
| 7,267,466 | B2 | 9/2007 | Reiss | |
| 2002/0012564 | A1 | 1/2002 | Chao | |
| 2002/0074559 | A1 | 6/2002 | Dowling et al. | |
| 2002/0080615 | A1 | 6/2002 | Marshall | |
| 2002/0093649 | A1 | 7/2002 | Brass | |
| 2002/0191396 | A1 | 12/2002 | Reiff et al. | |
| 2003/0007345 | A1 | 1/2003 | Cooper et al. | |
| 2003/0007346 | A1 | 1/2003 | Cooper et al. | |
| 2003/0098425 | A1 | 5/2003 | Sosinsky | |
| 2003/0123254 | A1 | 7/2003 | Brass et al. | |
| 2003/0142489 | A1 | 7/2003 | Cooper | |
| 2003/0165065 | A1 | 9/2003 | Roller et al. | |
| 2003/0169600 | A1 | 9/2003 | Amano | |
| 2004/0223342 | A1 | 11/2004 | Klipstein et al. | |
| 2004/0228124 | A1 | 11/2004 | Reiff et al. | |
| 2005/0007777 | A1 | 1/2005 | Klipstein et al. | |
| 2005/0083687 | A1 | 4/2005 | Brass et al. | |
| 2005/0122713 | A1 | 6/2005 | Hutchins | |
| 2005/0225968 | A1 | 10/2005 | Hatherill et al. | |
| 2005/0265035 | A1 | 12/2005 | Brass et al. | |
| 2007/0189019 | A1 | 8/2007 | Klipstein | |
| 2007/0217188 | A1 | 9/2007 | Klipstein | |
| 2007/0247844 | A1 | 10/2007 | Brass | |
| 2007/0253188 | A1 | 11/2007 | Klipstein | |
| 2008/0191232 | A1 | 8/2008 | Lee et al. | |
| 2008/0198615 | A1 | 8/2008 | Klipstein | |
| 2008/0212319 | A1 | 9/2008 | Klipstein et al. | |
| 2009/0161351 | A1 | 6/2009 | Klipstein et al. | |

OTHER PUBLICATIONS

Lumileds Lighting LLC, Secondary Optuics Design Consideration for SuperFlux LEDs, 2002, Publication No. AB20-5 (Sep. 2002), pp. 17-20.

Examiner's Report dated Jan. 27, 2011 from Canadian Application No. 2,652,218.

Notice of Allowance for Canadian Patent Application No. 2,652,218 to Brasscorp Limited. Canadian Intellectual Property Office. Apr. 22, 2013.

* cited by examiner

LED WORK LIGHT

CROSS-REFERENCE TO RELATED APPLICATIONS

This application is a Continuation-in-Part of U.S. patent application Ser. No. 11/083,086, entitled LED WORK LIGHT, filed Mar. 18, 2005 which claims the benefit of the filing date of U.S. Provisional Patent Application No. 60/521,240 filed Mar. 18, 2004 under the title LED WORK LIGHT, the filing date of U.S. Provisional Patent Application No. 60/521,680 filed Jun. 16, 2004 under the title LED WORK LIGHT, the filing date of U.S. Provisional Patent Application No. 60/521,689 filed Jun. 17, 2004 under the title LED WORK LIGHT, the filing date of U.S. Provisional Patent Application No. 60/521,738 filed Jun. 28, 2004 under the title LED WORK LIGHT and the filing date of U.S. Provisional Patent Application No. 60/521,888 filed Jul. 17, 2004 under the title LED WORK LIGHT.

This application is also a US National Stage Application of International Application No. PCT/CA2007/000802 filed May 4, 2007 under title LED WORK LIGHT which claims priority from, and the benefit of, the filing date of U.S. Provisional Patent Application 60/797,480 filed 4 May 2006 under title LED WORK LIGHT, the filing date of U.S. Provisional Patent Application 60/815,336 filed 21 Jun. 2006 under title LED WORK LIGHT, the filing date of U.S. Provisional Patent Application 60/818,426 filed 3 Jul. 2006 under title LED WORK LIGHT, the filing date of U.S. Provisional Patent Application 60/843,647 filed 11 Sep. 2006 under title LED WORK LIGHT, the filing date of U.S. Provisional Patent Application 60/855,357 filed 30 Oct. 2006 under title LED WORK LIGHT.

The contents of the above applications are hereby incorporated by reference into the Detailed Description hereof.

TECHNICAL FIELD

The invention relates to work lights and components therefore, and to lenses. More particularly, it relates to LED work lights and components therefore, and to lenses for use with LEDs.

BACKGROUND ART

Work lights, often known as "trouble lights", are widely used in automotive repair shops and other repair settings and construction settings. Such work lights are often in a form that can alternatively be handheld or hung from a suitable elevated object such as a raised automobile hood.

Incandescent work lights have been in use, but they have some drawbacks. One drawback is that work lights are all too often dropped or knocked down and fall onto a hard surface, and this often results in breakage of the bulb or its filament. An additional drawback of incandescent work lights is a safety hazard that results from the possibility of the bulb breaking with its hot filament in close proximity to flammable material such as spilled flammable liquid if the work light suffers a fall.

Fluorescent work lights exist and they have advantages over incandescent work lights, namely greater energy efficiency and a reduced hazard of igniting flammable materials if they suffer a fall. However, fluorescent work lights can experience breakage of their bulbs if they suffer a fall. Although breakage of an operating fluorescent bulb is not as likely to ignite nearby flammable materials as breakage of an incandescent bulb is, there is still a slight chance that a fluorescent bulb can ignite adjacent flammable materials if broken while operating since fluorescent lamps normally have hot filaments while they are operating. There are fluorescent work lights that have impact cushioning means included to increase their ability to survive falls, but they still have a slight chance of experiencing breakage of their bulbs if they fall onto a hard surface.

LED work lights are better able to survive falls than are work lights that have glass bulbs. Furthermore, LEDs do not generally operate with parts hot enough to ignite flammable materials, so even falls that do result in breakage are less likely to cause fires than are similar falls of work lights that have glass bulbs.

The prior art has LED work lights. Many produce light that is insufficiently intense or in the form of an excessively narrow beam. It is possible to achieve adequately intense light in an adequately wide beam by using a large number of LEDs. However, a work light having a sufficient number of LEDs and sufficient power input to achieve adequately intense light in an adequately wide beam without overheating of the LEDs is generally large and expensive.

As described further herein some features of some aspects of the invention will address some of the issues raised above. Other features and other aspects will address other issues with existing LED lights to provide alternatives or improvements thereto.

DISCLOSURE OF THE INVENTION

In a first aspect the invention provides an LED work light including a handle section and a head section and a structural tube. The structural tube extends through the head section and the handle section. The light further includes at least one LED mounted in the tube within the head section, and power receiving means for the at least one LED to receive electrical power. The light further includes an LED board in the tube within the head section and the at least one LED is attached to the LED board. The light further includes a heatsink in the tube within the head section and the LED board is fastened to the heatsink in a manner that achieves thermal contact between the at least one LED and the heatsink. The structural tube is transparent in the head section for light from the at least one LED to emit from the work light.

At least one of the at least one LED may include a plurality of LED chips within a diffusing dome. The at least one LED may comprise separate electrical terminals for each chip. The chips within each LED may be connected in series with each other.

The at least one LED may receive power from a boost converter. The entire structural tube may be transparent. The at least one LED may include a white LED.

The LED work light may include a battery to supply power to the power receiving means. The battery may be rechargeable for recharging the battery. The LED work light may include a charging circuit for recharging the battery.

The may produce a beam that is at least about 40 degrees wide and about 100 degrees wide or less.

A convex lens may be disposed forward of at least one of the at least one LED to achieve a beam having a width of at least above 40 and about 100 degrees or less.

The at least one LED may have a voltage drop of about 80-85% of the voltage of the battery, and current through the at least one LED may be controlled or limited by at least one resistor. An individual LED chip may be connected directly in parallel with at least one other LED chip. Individual LED chips may be connected together in a series-parallel manner.

At least one LED may include only one dropping resistor for each LED with only some of the LED chips connected in series with each other. All of the chips in at least one of the at least one LED may be connected in parallel with each other.

All of the chips in at least one of the at least one LED may be connected together in a series-parallel manner. At least one LED may be mounted to an opposite side of the LED board from a side of the LED board that faces a direction which light from the at least one LED is directed towards. At least one of the at least one LED may be a multichip LED.

The LED work light may include a convex lens associated with at least one of the at least one LEDs to concentrate the light from its associated LED into a beam that is between about 40 to 100 degrees wide.

At least one of the at least one LED may be pressed against the heatsink by the LED board. The LED work light may receive electrical power from an external power source that is designed to provide limited output current if the power source is shorted.

The LED work light may include grounding means. The LED work light may receive power from the external power source through two conductors, and may include a separate grounding conductor. The LED work light may receive power from the external power source through two conductors, and one of the two conductors may also be used as a grounding conductor.

In a second aspect the invention provides an LED work light including at least one LED and a lens associated with the at least one LED, wherein at least one of the at least one associated lens has a curved surface that is nonhemispheric while a cross section of the nonhemispheric surface of the lens includes at least one circular arc and all arcs arcs circular.

A lens associated with at least one of the at least one LED may be a convex lens that concentrates the light from its associated LED into a beam that is between about 40 to 100 degrees wide. At least one lens may be a concavoconvex lens.

A convex surface of the at least one lens may be hemispheric and a concave surface may be non-hemispheric. The concave surface may be a cross section including a lens axis with at least one circular arc and without non-circular arcs.

The LED work light may include a single piece transparent lens assembly including more than one concavoconvex lens with a hemispheric convex surface and a non-hemispheric concave surface that has a cross section including a lens axis with at least one circular arc and all arcs being circular.

The LED work light may include magnets to allow the LED work light to be attached to a magnetic surface.

In a third aspect the invention provides an LED work light comprising a head section, a handle section, at least one LED within the head section, and a transparent shield. The head section includes transparent structural material that allows light from the at least one LED to emit from the head section. The transparent shield is suitable for protecting said transparent structural material from scratches and abrasions. The transparent shield is removable and replaceable.

The transparent shield may be in the form of a tube that surrounds the head section of the LED work light. The transparent shield may being the form of a circular tube. The transparent shield may be made of a plastic that is related to polyethylene. The transparent shield may be made of polyethylene terephthalate. The transparent shield may be made of polytetrafluoroethylene. The transparent shield may include a plurality of laminations with the laminations removable one at a time by means of removing an outermost lamination. The transparent shield may include an adhesive between respective laminations.

The LED work light may include at least one lens, each lens associated with a respective one of the at least one LED. The LED work light of claim 42, wherein the at least one lens concentrates light from its associated LED into a beam of width of between about 40 degrees and about 100 degrees.

In a fourth aspect the invention provides an LED work light including a head section, a handle section, at least one LED within the head section, a lens associated with each of the at least one to concentrate the light from the at least one LED, and a transparent shield suitable for protecting the lens associated with each of the at least one LED from scratches and abrasions. The transparent shield is removable and replaceable.

Sealing means may be used at the edges of the transparent shield. The sealing means may include a gasket. The sealing means may include an O-ring. The sealing means may include part of a rubber cover. The rubber cover used for sealing means may be a handle cover. The rubber cover used for sealing means may include a cap at one end of a tubular structure.

In a fifth aspect the invention provides an LED work light including a handle section and a head section and at least one LED mounted in the head section and means for the at least one LED to receive electrical power and further including magnets within the LED work light to allow the LED work light to be attached to a magnetic surface.

The LED work light may have a beam with a width that is between at least about 40 degrees and about 100 degrees or less. The LED work light may include at least one lens to concentrate light from at least one LED into the beam. The LED work light may include a housing of polygonal shape to allow it to be attached to a magnetic surface so that light from the LED work light is directed from the LED work light at an angle from the surface that the LED work light is attached to.

The housing may have a shape of a partial octagon to permit the LED work light to be attached to a magnetic surface so that light from the LED work light is directed into a direction 45 degrees from the magnetic surface.

In a sixth aspect the invention provides an LED work light including a head section and a handle section and at least one LED of a type suitable for mounting onto a heatsink, a heatsink that the at least one LED is mounted onto, a structural plate disposed forwards of the heatsink, and a hole in the structural plate associated with each LED of the at least one LED.

The LED work light may include a lens mounted onto the structural plate in front of and associated with at least one of the at least one LED. The heatsink may be a metal core printed circuit board. The structural plate may be a printed circuit board.

In a seventh aspect the invention provides an LED work light including a head section, a handle section and a hook. The head section has an axis, and the LEDs are mounted within the head section such that the light output from the LEDs is directed from the head section at an angle from the axis of the head section. The transparent shield may be made of polycarbonate.

BRIEF DESCRIPTION OF THE DRAWINGS

For a better understanding of the present invention and to show more were clearly how it may be carried into effect, reference will now be made, by way of example, to the accompanying drawings which show the preferred embodiment of the present invention and in which.

MODES FOR CARRYING OUT THE INVENTION

Figure 1:
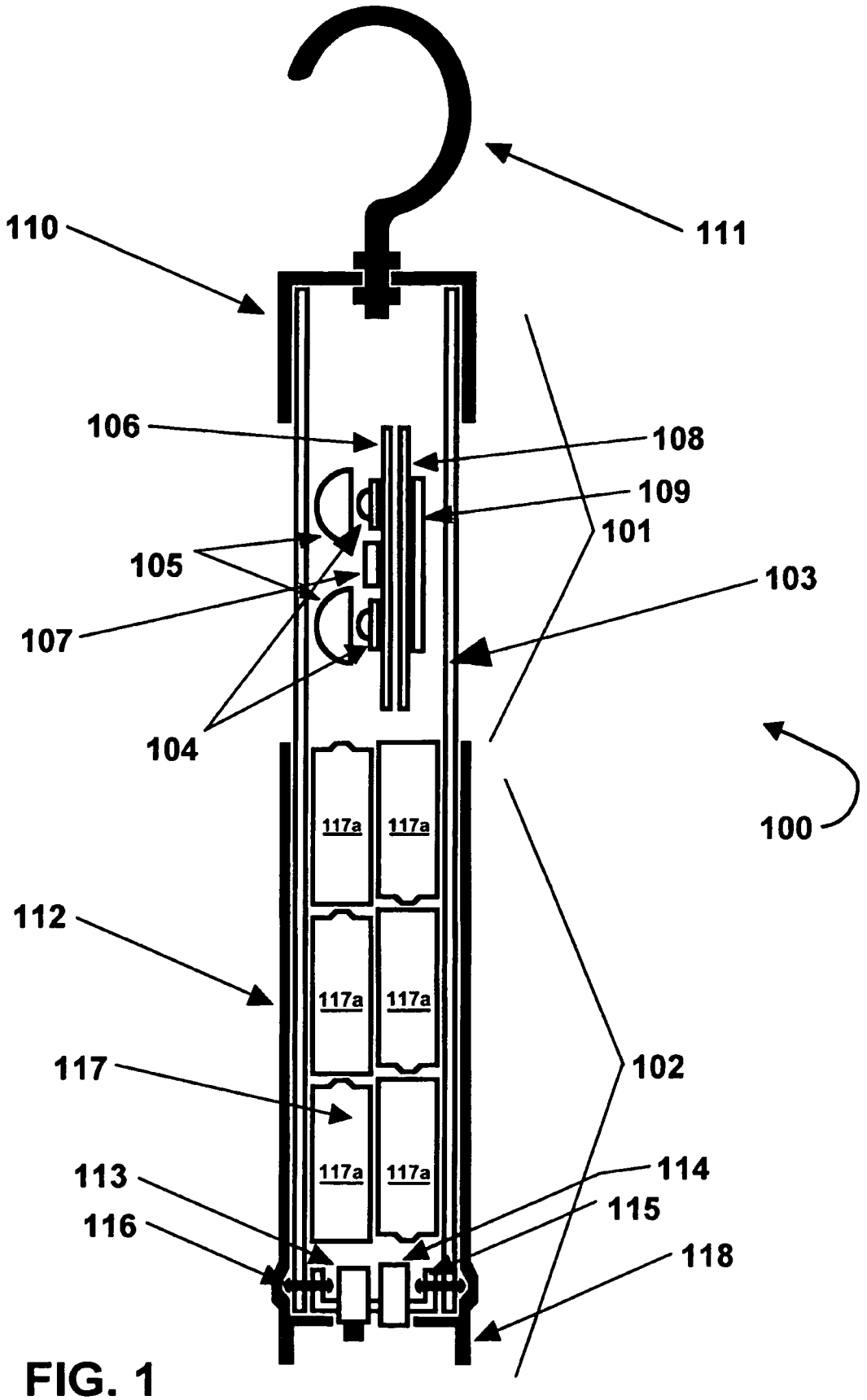
FIG. 1 is a cross sectional side view of a first example embodiment of a work light.

Referring to FIG. 1, an LED work light 100, has a head section 101 and a handle section 102. The LED work light 100 has a transparent plastic tube 103 as a main structural member, which is common to both the head section 101 and the handle section 102. The plastic tube 103 is preferably polycarbonate but may alternatively be made of a different plastic such as acrylic. Other suitable transparent materials, plastic or non-plastic, may be utilized for the tube 103. The plastic tube 103 may have ridges and/or one or more grooves (not shown) to hold.

The LED work light 100 has at least one LED 104. The LED work light 100 is shown as having two LEDs 104, although a different number of LEDs 104 can be used. LEDs 104 are preferably mounted onto an LED board 106. The LED board 106 is preferably also a heatsink and may be made of metal core printed circuit board. Alternatively, an LED board 106 can be made to have useful heatsinking capability by attaching a conventional circuit board to a metal heatsink such as a piece of sheet metal. A conventional circuit board incorporated into a heatsinking LED board 106 may have large copper pads and a large number of thermal vias to conduct heat away from LEDs 104. In this description when referring to an LED, the LED includes its package and each LED chip within the package.

The LEDs 104 are multichip LEDs with diffusing domes and preferably have separate electrical terminals for each chip. Any of the LEDs 104 may be, for example, Citizen Electronics of Japan CL-652-8WN, which has 8 chips and 16 terminals and a diffusing dome approximately 5 millimeters in diameter. This description will often reference the Citizen Electronics LED as an example of an LED that can be suitable for embodiments providing some of the features and functions described herein. It is to be understood that other LEDs having different characteristics may be utilized to provide embodiments with some or all of the features and functions described herein. This LED has an essentially lambertian radiation pattern, with a nominal beam width of 120 degrees.

Preferably LEDs 104 produce essentially white light for most illumination tasks that LED work lights would be used for. The Citizen Electronics CL-652-8WN is a white light LED. A combination of white and colored LEDs can be used in an LED work light 100 to adjust the color balance or the color rendering properties of the light produced by the LED work light 100. For example, one or more red and one or more green LEDs can be used in addition to white light LEDs 104 to achieve either a high color rendering index or even exaggerated color rendering. One or more blue LEDs can be added to a combination of red, green and white light LEDs to achieve good or exaggerated color rendering while maintaining a high color temperature typical of most white LEDs. Any colored LEDs may or may not have multiple LED chips, diffusing domes or multiple electrical terminals. Other combinations of colour LEDs may be used including combinations having a single LED of a single colour.

Since most high power LEDs 104 have a beam width greater than 100 degrees, light from each of the LEDs 104 is preferably concentrated by associated convex lenses 105 disposed forward of their associated LEDs 104 in order to increase the intensity of the light directed forward from the LEDs 104. The convex LEDs 105 are a form of optic. Preferably the lenses 105 concentrate the light from their associated LEDs 104 into a beam that is at least about 40 degrees wide and about 100 degrees wide or less.

Alternatively, other optical devices such as reflectors can be used to concentrate the light from the LEDs 104 into a beam. Further alternatively, no optics can be used if LEDs 104 are obtained that produce a suitable beam by themselves or that produce a sufficient quantity of light without being concentrated by any optics.

An advantage of having the LEDs 104 being multichip ones with diffusing domes is that their associated lenses 105 can sometimes be simple hemispheres without causing an undesirable bright ring at the edge of the beam. Use of hemispherical and most other convex lenses with LEDs having a single chip and a clear dome or clear body and with a radiation pattern wider than 100 degrees such as many Lumileds Luxeon™ models tends to produce beams with bright rings at their edges. This can be solved by having a rear surface of a convex lens being slightly concave and with curvature of the concave surface being sharper towards the edge of the concave surface than toward the center of the concave surface. Depending on the size of a lens 105 and other factors such as the size of the diffusing dome of an LED 104, a hemispherical or other planoconcave lens may or may not produce a beam with a bright ring at its edge when concentrating the light from a multichip LED 104 having a diffusing dome. A hemispherical lens 105 made of acrylic and having a diameter of 0.5 to 0.75 inch has been found to work if a Citizen Electronics CL-652-8WN is being used as the LED 104. A hemispherical acrylic lens 1 inch in diameter with the Citizen Electronics CL-652-8WN produces a beam that has only a mild and possibly tolerable bright ring at its edge.

Lenses 105, whether hemispherical or otherwise, are preferably made of acrylic or polycarbonate. Alternatively lenses 105 may be made of a different transparent material such as glass. Polycarbonate lenses can be made thinner than acrylic ones because polycarbonate has a higher refractive index than acrylic has. Making a thermoplastic lens thinner can improve its ability to be injection molded.

Even if an acrylic hemispherical lens 105 of a given diameter with a given LED 104 produces a beam that lacks a bright ring at its edge, it may be preferable to use a different shape lens 105. For example, a polycarbonate concavoconvex lens can collect and concentrate into a beam more light from the LED 104 than a hemispherical lens.

The LED board 106 is shown as having circuitry 107 to ensure that the current flowing through the LEDs 104 is at a proper magnitude. The circuitry 107 may be one or more resistors, linear current regulators, switching current regulators or boost converters. Alternatively, such circuitry may be located elsewhere within the LED work light 100. Further alternatively, it may be found possible to power the LEDs 104 without such circuitry, such as in a case where the LEDs 104 receive power from a battery 117 that has significant internal resistance.

The LED board 106 preferably receives power from a battery 117 that are contained within the LED work light 100. Alternatively, the LED work light 100 may receive power from an external power source. Preferably the battery 117 is rechargeable. A rechargeable battery 117 may be nickel cadmium, NiMH, lead acid, lithium ion, or lithium polymer. As shown made up of a plurality of battery cells 117*a*; however, other battery 117 configurations are possible as will be evident to those skilled in the art.

If the LEDs 104 have chips that have a typical forward voltage drop of sufficiently less than 3.6 volts, then each chip in the LEDs 104 can, for example, receive power through a resistor in the circuitry 107 from a battery 117 comprising three NiMH cells 117*a*. If in addition the chips in the LEDs 104 are connected in series pairs, then each series pair of LED chips may, for example, receive power through a resistor in the circuitry 107 from a battery 117 comprising six NiMH cells 117*a*. If the forward voltage drop of an LED 104 is 80-85% of the voltage produced by the battery 117, then resistors in the circuitry 107 can be used to control the amount of current flowing through an LED 104 with 80-85% of the power drawn from the battery 117 being delivered to the LEDs 104, and such resistors will typically drop sufficient voltage for the current through the LEDs 104 to be adequately reliably at a proper magnitude. Alternatively, a switching current regulator (such as the one shown in FIG. 8 and associated detailed description of U.S. patent application Ser. No. 11/083,086 on 18 Mar. 2005 and published as US20050265035A1 on 1 Dec. 2005 the content of which is hereby incorporated by reference herein), or a boost converter (such as described in FIGS. 11-15 and associated detailed description of U.S. patent application Ser. No. 10/885,031 on 7 Jul. 2004 and published as US20050007777A1 on 13 Jan. 2005 the content of which is hereby incorporated by reference herein) may be used. A switching regulator or a boost converter in lieu of resistors for circuitry 107 can, for example, reduce losses in circuitry 107; however, a switching regulator or boost converter may not be economically warranted. If the voltage drop of an LED 104 is too close to the voltage produced by the battery 117 then resistors may not adequately control the magnitude of current flowing through the LEDs 104.

The LEDs 104 may have chips of sufficiently identical characteristics to permit connecting the chips in parallel or in a series-parallel manner without separate current limiting means for each chip or series combination thereof. This can simplify construction of the LED work light 100 by having each LED 104 having a single dropping resistor even if the chips in the LED 104 are not all in series with each other. At least one multichip LED by Citizen Electronics is designed to permit connecting the individual chips of the LED in parallel with each other and to use only one dropping resistor or other current limiting means to limit the current through all of the chips. Such a multichip LED can also have its chips connected together in a series-parallel manner with only one dropping resistor for the multichip LED.

White LEDs having Cree XT series chips or other LED chips with similarly low voltage drop for white LEDs can have voltage drops of 3.1-3.15 volts per chip at a current of 20-25 milliamps through each chip.

The Citizen Electronics CL-652-8WN was found to have a voltage drop of 3.15 volts per chip with 25 milliamps of current through each chip, which is approximately 84% of the voltage of a lightly loaded battery 117 comprising three NiMH cells 117*a*. Although the Citizen Electronics CL-652-8WN can safely receive more than 25 milliamps through each chip, its light output can be sufficient at a lower current that results in a lower voltage drop.

One advantage of multichip LEDs 104 that have separate terminals for each chip is that the same LEDs can be used in different versions of the LED work light 100 that have different types of circuitry 107. For example, the circuitry 107 may be changed from a set of resistors to a boost converter, with the boost converter powering LEDs 104 if all of their chips are connected in series. Many boost converter circuits achieve the current limiting that is typically necessary for LEDs but only if the load voltage is either greater than or essentially equal to the supply voltage, and best utilized with several LED chips in series to achieve a relatively high load voltage. Another advantage of LEDs 104 that have multiple chips with separate electrical terminals is that the LEDs 104 can be used to replace different LEDs of different voltage drops. For example, an LED work light 100 having Lumileds of San Jose, Calif. "Luxeon™", 1 watt or 3 watt LEDs can have all chips in the LED 104 connected in parallel with each other, either directly or with current dividing resistors. Lumileds "Luxeon V™" LEDs can be replaced by LEDs 104 that have their chips connected into a parallel set of series pairs, whether with or without current dividing resistors.

For clarity, electrical connections from the battery to the switch and from the switch to the circuitry 107 are not shown; however, it is understood that appropriate electrical connections between the electrical components, for example by wires and printed circuit board traces, are provided.

The LED work light 100 is shown as having a separate charging board 108 with charging circuitry 109 to recharge the shown battery 117. Alternatively, the LEDs 104 and charging circuitry 109 can be mounted onto the same board, preferably along with the circuitry 107 typically required by the LEDs 104. If the charging circuitry 109 and the LEDs 104 are mounted onto the same board, then the charging circuitry 109 may, if desired, be mounted on the opposite side of that board from the side that the LEDs 104 are mounted on.

Also included in the LED work light 100 are a switch 113 and a charging jack 114. The switch 113 is preferably a pushbutton switch; however, other switches may be used such as for example a toggle switch. The switch 113 and charging jack 114 are shown as being mounted in a base cap 115. As shown, the base cap may be mounted to the plastic tube 103 with rivets 116. Other mounting means may be used for the switch 113 or jack 114, or for the cap 115.

The switch 113 is shown as being mounted in the bottom of the LED work light 100. Alternatively it may be mounted in a side surface of the LED work light 100 or the top of the LED work light 100.

A handle cover 112 is shown as covering the handle section 102 of the LED work light 100. The handle cover 112 preferably also covers much of the base cap 115. The handle cover 112 may be made of rubber or another resilient material to protect from impact. The handle cover 112 can also provide a slip resilient grip surface. The handle cover 112 may have an extension 118 to protect the switch 113 and charging jack 114 from impacts. The extension 118 can also be used to rest the light 100 in an upright position.

The LED work light 100 is also shown as having a top cap 110 with a hook 111. Preferably the hook 111 can rotate within the top cap 110. The top cap 110 may be of a material similar to that of the handle cover 112 and liquid resistant when mounted to the tube 103. The handle cover 112 and tube 103 can be in sufficiently close contact or sealed to be liquid resistant.

Figure 2:
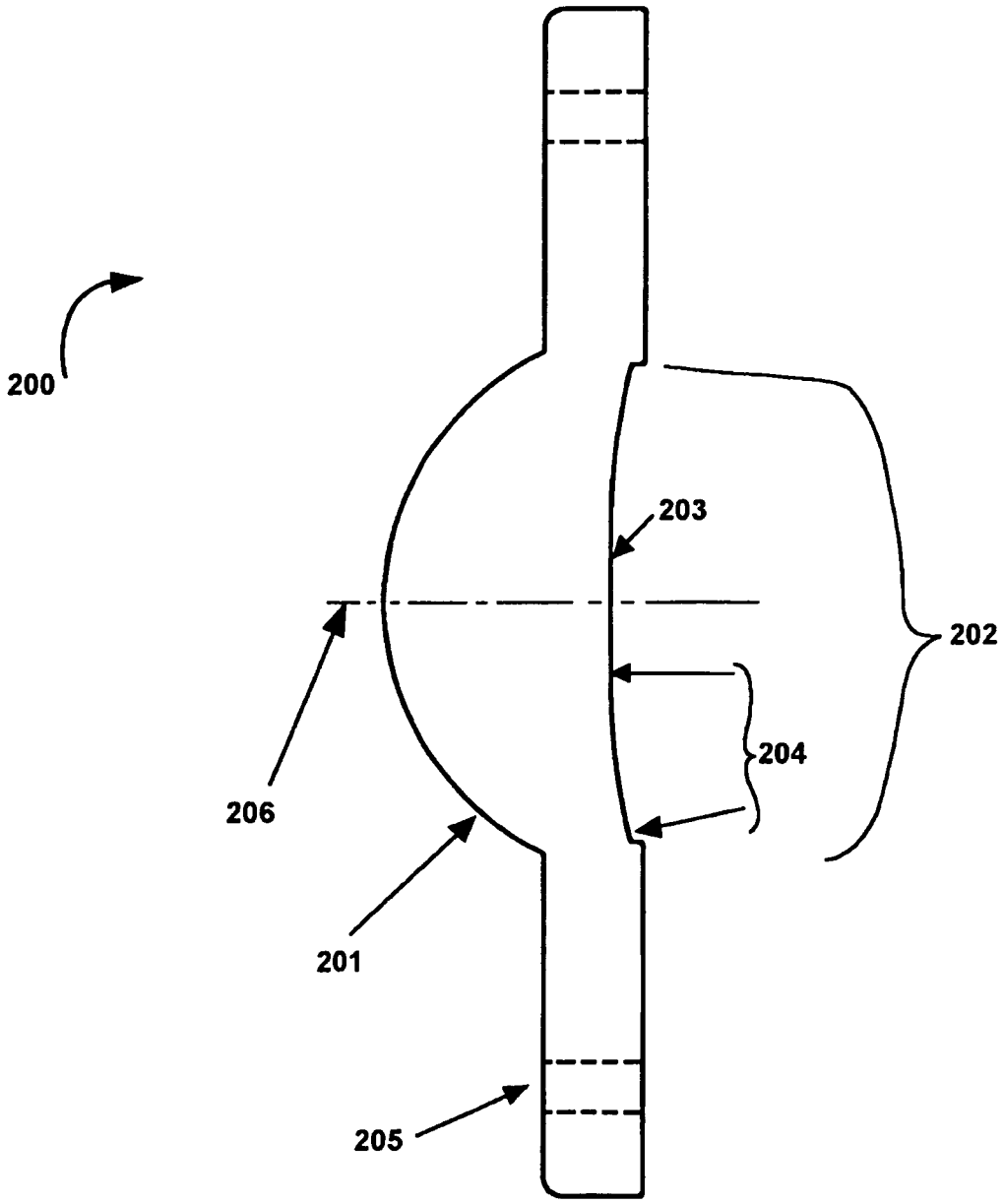
FIG. 2 is a cross sectional side view of an example embodiment of a lens that may be used in a work light such as those described herein.

Referring to FIG. 2, a lens 200 that may be used in the LED work light 100 of FIG. 1 is shown. The lens 200 may be similar to the lenses 105 of FIG. 1; however, the lens 200 is shown in greater detail and with example mounting means.

The lens 200 is shown with a convex forward surface 201 and a rear surface 202. The lens 200 is shown as being concavoconvex, having the rear surface 202 being concave. As an alternative example, a planoconvex lens may be used. A planoconvex lens may an aspheric convex forward surface 201.

The rear surface 202 of concavoconvex lens 200 is shown having a flat central region 203 and a curved outer region 204. Preferably the curved region 204 has its cross section in a plane containing the axis 206 of the lens 200 being a circular arc. This combination of the flat central region 203 and the curved outer region 204 is selected to approximate a curved surface that is less sharply curved towards its center and more sharply curved toward its edge. While the lens 200 may work better if concave rear surface 202 is a single curve that gradually sharpens toward its edge (and such embodiments are included in the principles described herein), making of a mold for producing the lens 200 may be simplified by having all curves in the lens 200 describable as circular arcs.

The convex forward surface 201 of the lens 200 is preferably a spherical curve. The purpose of having the convex forward surface 201 spherical is also to possibly simplify making of a mold used to produce the lens 200. Aspherical embodiments are included in the principles described herein.

The lens 200 is also shown as having holes 205 to permit mounting by means of screws or rivets or the like. The lens 200 may be otherwise mounted, for example, using epoxy.

Convex lenses other than the specific lens 200 may also be used as the lenses 105 in the LED work light 100 of FIG. 1. For example, a single molded transparent piece may have more than one lens element. Such a molded lens assembly with more than one lens element preferably has each lens element having a hemispheric convex forward surface and a non-hemispheric concave rear surface with each rear surface having at least one circular arc and no non-circular arcs in a cross section containing the axis of the lens element for reasons described previously. Again, other convex lenses may be used.

Figure 3:
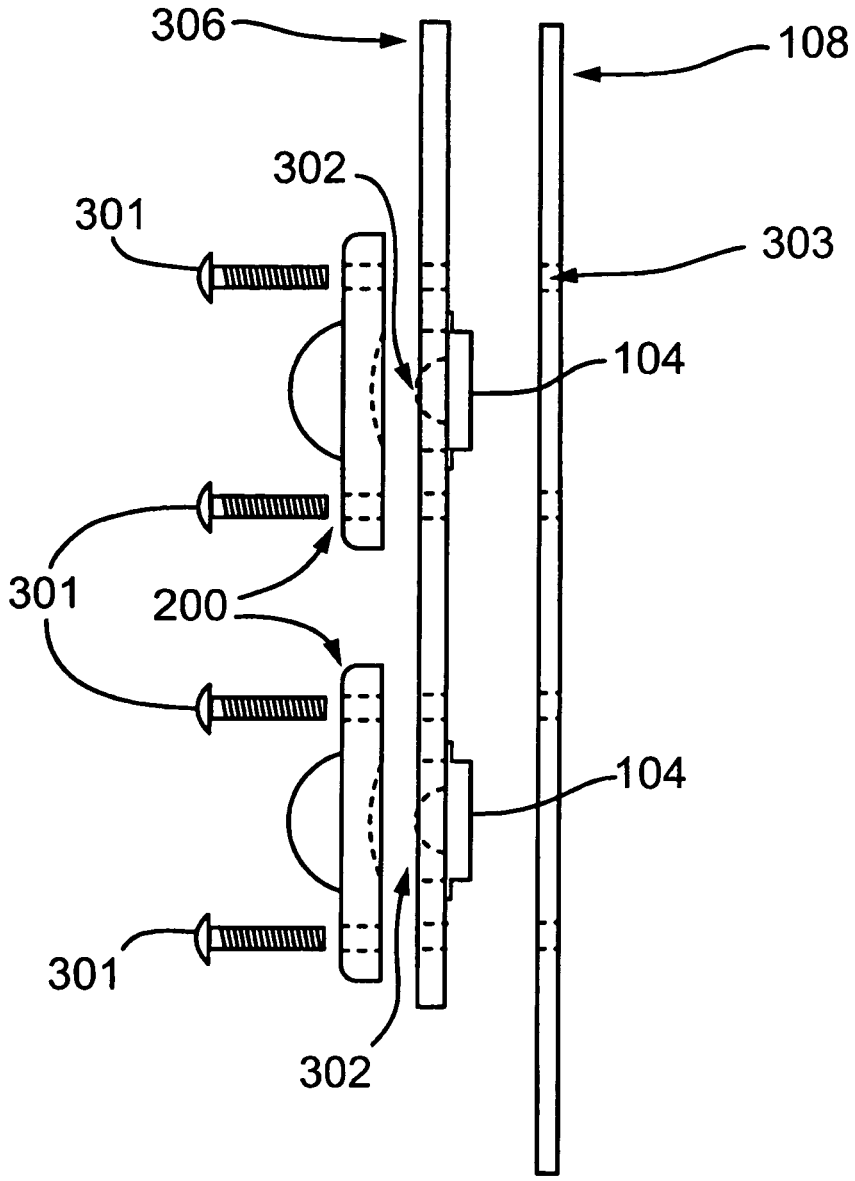
FIG. 3 is an exploded side view of an example embodiment of an LED light source assembly that may be used in a work light such as those described herein.

Referring to FIG. 3, an alternative example assembly of an LED board 306, heatsink 108 LEDs 104, and lenses 200 is shown. Such an assembly differs from the arrangement shown in FIG. 1 by having the LEDs 104 being placed against the heatsink 108 when the assembly is assembled. The LED board 306 differs from the LED board 106 of FIG. 1 by having holes to allow the LED board 306 to fit around the LEDs 104 in order to allow the LEDs 104 to directly contact the heatsink 108. Such an alternative assembly may, for example, be used in a tubular LED work light that is otherwise similar to the LED work light 100 of FIG. 1.

The LEDs are preferably soldered to the rear surface of the LED board 306. The light emitting domes of the LEDs 104 protrude through holes 302 that are provided in the LED board 306. The LED board is fastened to the heatsink 108, such as with the shown screws 301. The heatsink may have tapped screw holes 303 for any screws 301. Alternatively, any screw holes in the heatsink 108 may be untapped and the screws 301 may screw into nuts. Further alternatively, other means of fastening the LED board 106 to the heatsink 108 such as rivets may be used.

Fastening the LED board 306 to the heatsink 108 presses the rear surfaces of the LEDs 104 to the heatsink 108. Preferably the LED board 306 itself does not touch the heatsink 108.

Where desired, the LEDs 104 would be a type intended for mounting as shown. The Citizen Electronics CL-652-8WN is such an LED and has solder pad type terminals towards the edge of its forward surface to permit soldering to the LED board 106 in the orientation shown.

As shown, any screws 301 or other fasteners used to fasten the LED board 106 to the heatsink 108 may also be fastening the lenses 200 to the LED board 106. As shown, the lenses 200 would actually be pressing against the LED board 106 in order to press the LEDs 104 against the heatsink 108. Alternatively, the lenses 200 or different lenses may be mounted by other means such as glue or fasteners other than the ones used to fasten the LED board 106 to the heatsink 108.

A single LED board 306 is shown. Alternatively, more than one LED board 106 such as individual LED boards 306 for each of the LEDs 104 may be used. Further alternatively, the LEDs 104 may be glued or otherwise fastened to the heatsink 108 in lieu of having fastening means fastening the LED board 306 to the heatsink 108.

Figure 4:
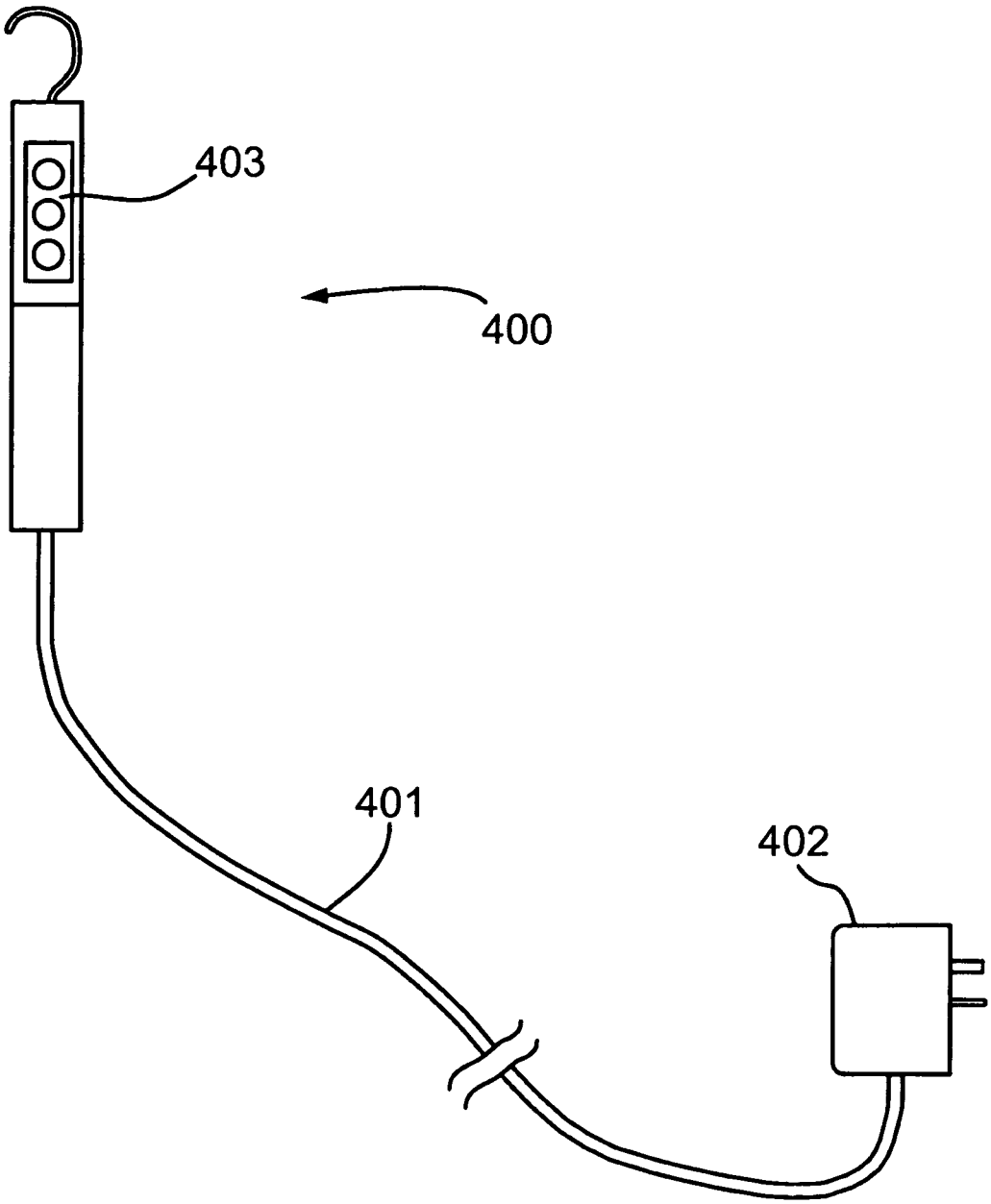
FIG. 4 is a diagrammatic illustration of a second example embodiment of a work light.

Referring to FIG. 4, an LED work light 400 can be made like that of the LED work light 100 of FIG. 1 operating from electrical power received via a cable 401 from an external power source 402. The external power source 402 is shown as being of a "wall transformer" type for connection to a line power source, not shown.

The external power source 402 may have current limiting means such as current regulation or a resistor to minimize production of sparks if the cable 401 is inadvertently severed and shorted. This can permit use of the LED work light 400 in locations that are classified as hazardous due to presence or possible presence of flammable or explosive vapors or dust.

The LED work light 400 may lack a switch in order to minimize the possibility of sparks. Alternatively, the LED work light 400 may have a switch that is safe to use in locations having flammable or explosive vapors or dust. Further alternatively, a switch may be mounted on the external power source 402.

Any switch in the LED work light 400 may be a position sensing switch so that the LED work light 400 will shut off in response to being placed in a particular position. Such a switch may be a mercury switch. Such a switch may have a metal ball or a metal cylinder or the like that rolls onto contacts when the switch is in a particular position. Such a switch may be a tilt switch, for example a tilt switch designed for pinball machines. Such a switch may be combined with electronic circuitry to minimize the amount of current that the switch has to conduct.

The LED work light 400 is shown as having three LEDs and associated lenses 403. Any number of LEDs and associated lenses 403 may be used. The lenses 403 may be comprised as convex elements in a single piece of transparent material rather than having each lens being a separate piece of transparent material as shown in FIGS. 1, 2 and 3.

Figure 5:
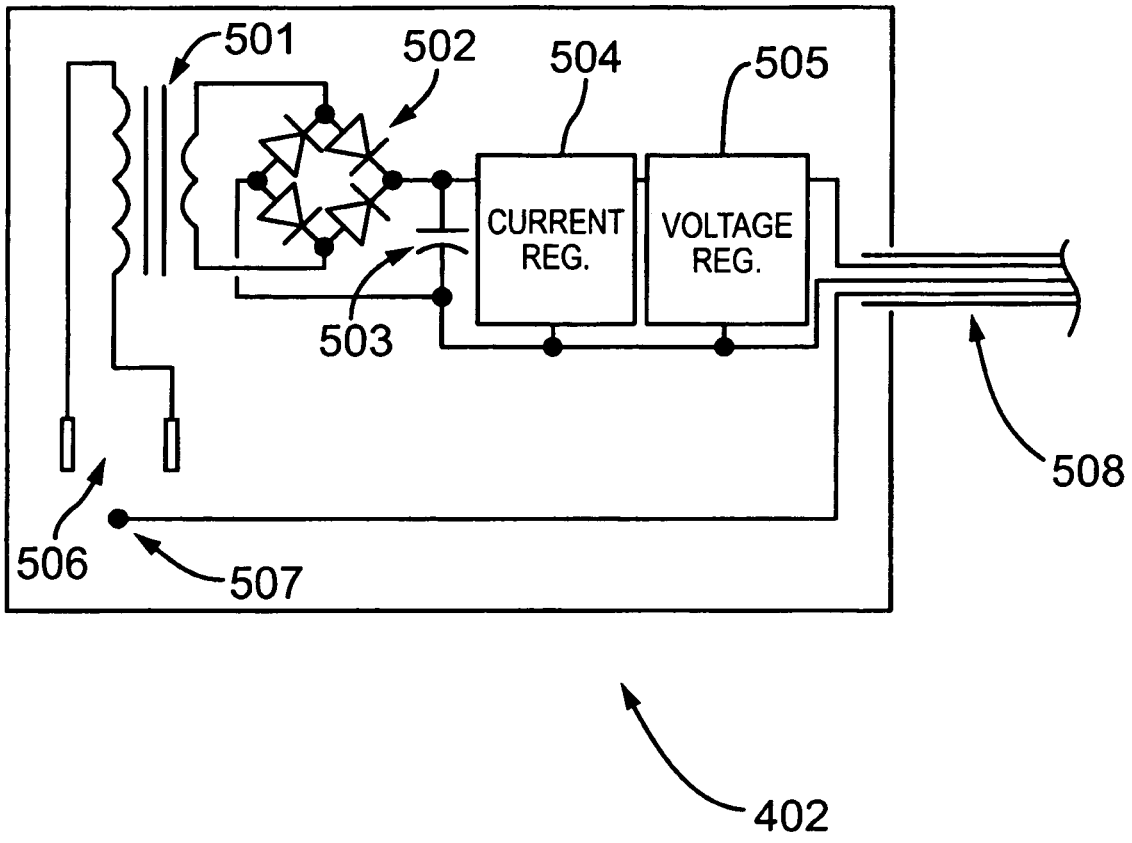
FIG. 5 is a block diagram of an example power supply that may be used in the work light embodiments described herein.

Referring to FIG. 5, the external power source 402 may comprise a transformer 501, a bridge rectifier 502, a filter capacitor 503, a current regulator 504 and a voltage regulator 505 as well as input prongs 506 including a grounding prong 507 and an output cable 508. Other arrangements may be used to achieve an external power source 402 that is suitable for use in hazardous locations. For example, a resistor may be used in lieu of the current regulator 504.

The external power source 402 is shown as having three conductors in its output cable 508. One of these conductors is shown as connected to the grounding prong 507. Alternatively, the output cable 508 may have only two conductors, with one of the two conductors both carrying output current and being connected to the grounding prong 507. Further alternatively, the output cable may lack a conductor connected to any grounding prong 507 and may further lack a grounding prong 507, although it is preferable to have a grounding means to eliminate accumulation of static electricity on any LED work light 400 that is to be used in hazardous locations.

Figure 6:
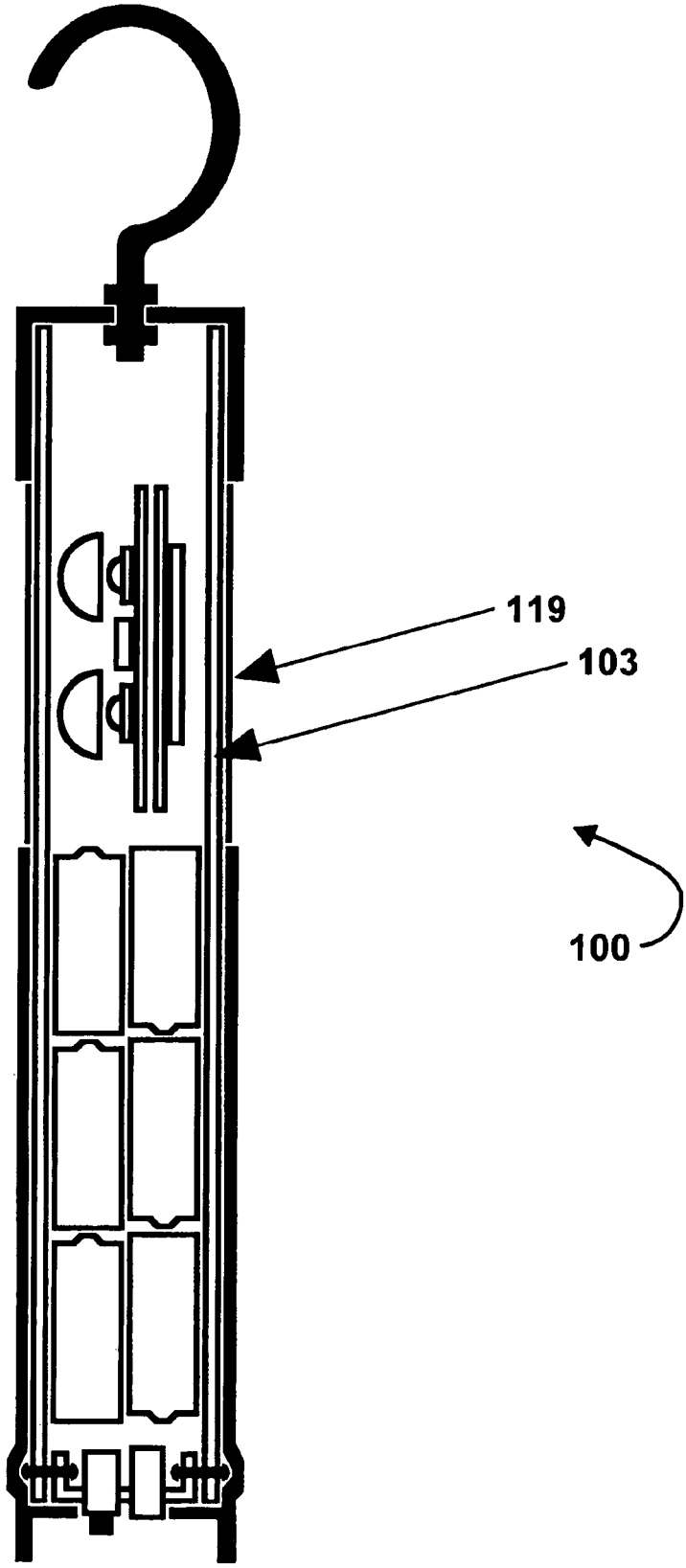
FIG. 6 is a cross sectional side view of a third example embodiment of a work light.

Referring to FIG. 6, an LED work light 100, similar to the LED work light 100 of FIG. 1, has added to it a transparent plastic cover 119 in the form of a tubular sleeve. The plastic cover 119 protects the transparent structural member 103, in this case a plastic tube, from scratches and abrasions. Since the plastic cover 119 does not have the structural requirements of the transparent plastic structure 103 being protected, the transparent plastic cover 119 can be made of a type of plastic selected for resistance to scratching and scraping. The transparent plastic cover 119 may be made of polyethylene terephthalate. Should a suitably transparent and otherwise usable form of another polyethylene-related plastic be usable, then the transparent plastic cover can be made of such a plastic, for example polyethylene, polypropylene or polytetrafluoroethylene. Alternatively, the transparent plastic cover 119 may be made of a non-polyethylene-related plastic such as polycarbonate or an acrylic. The cover 119 may be of a non-scratch resistant material that is sacrificed and replaced over time. The cover 119 may also be of suitable non-plastic material that is preferably shatter resistant.

Preferably a tubular transparent plastic cover 119 would be extruded in order to avoid an unsightly seem or mold lines. Alternatively, a tubular transparent plastic cover 119 can be made by rolling plastic sheet into a tube and then fastening the sheet into a tube such as by gluing or welding it. Further alternatively, a tubular transparent plastic cover 119 can be cut from a bottle-like structure made by blowing plastic into a mold. Other alternative ways of producing a transparent plastic tube such as casting are possible.

The transparent plastic cover 119 may be intended to be disposable when it has become excessively scratched and scraped, and afterwards replaced by the user of the LED work light 100.

Although the transparent structural tubes 103 for LED work lights have been made of acrylic or polycarbonate in past practice, it may be found practical to make the transparent structural tube 103 of polyethylene terephthalate to improve resistance to scratching, scraping, and some solvents, other materials may be used.

The cover 119 may be in the form of two longitudinally split cover halves, no shown, that combine about the cap 110 and cover 112 over the otherwise exposed portion of the tube 103. The halves may be formed in such a manner as to snap together, while permitting removal for cleaning or replacements. The halves may form a hinge on one side where the halves meet and a closure on the other side where the halves meet. Other techniques for attaching the halves are possible, such as for example by screws, glue, heat welding or the like.

Figure 7:
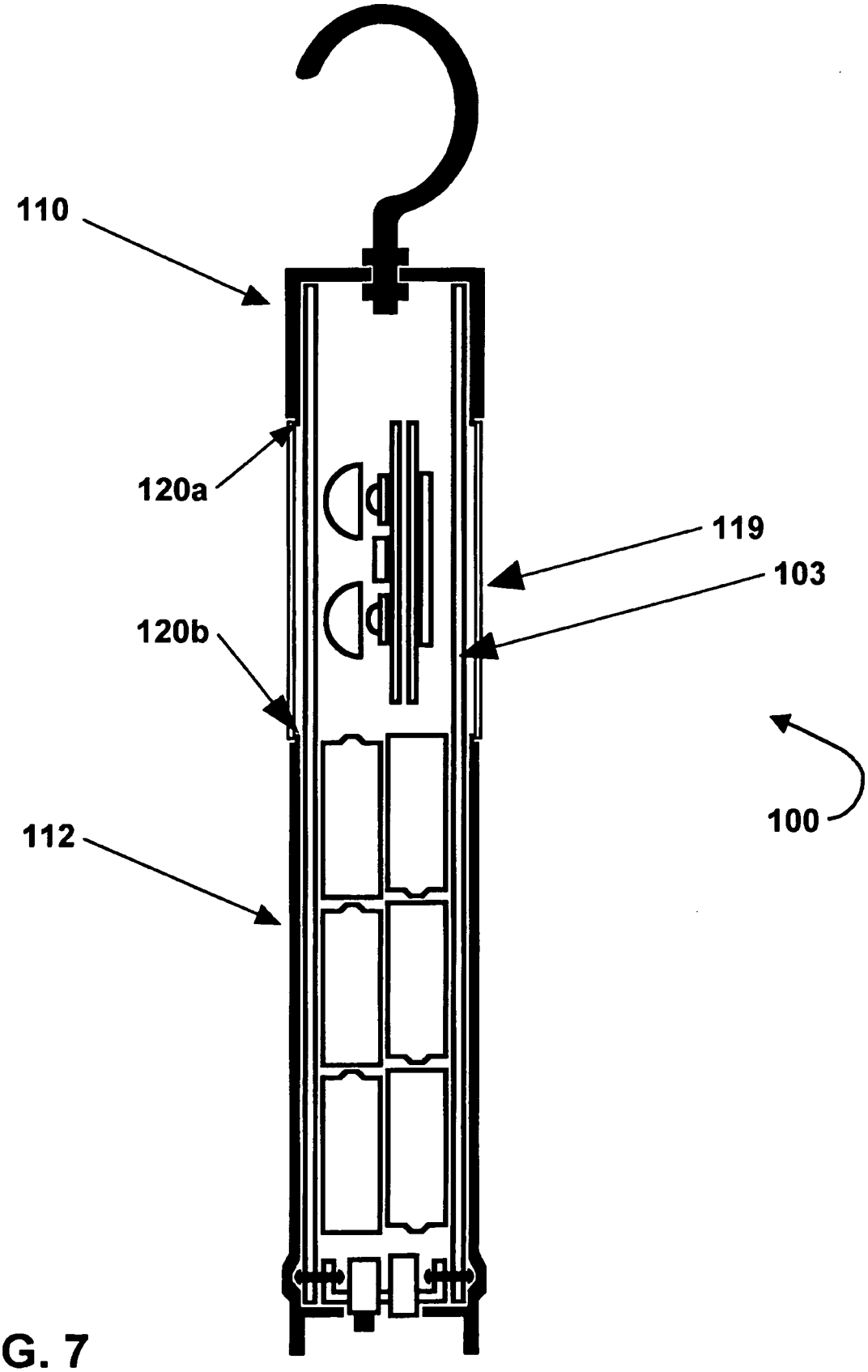
FIG. 7 is a cross sectional side view of a fourth example embodiment of a work light.

Referring to FIG. 7, the LED work light 700 is a modification of the LED work light 100 shown in FIG. 6 in that the top cap 110 and the handle cover 112 have narrowed regions 120*a*, 120*b* to fit tightly into the tubular plastic cover 119. The top cap 110 and the handle cover 112 are both preferably made of rubber to enable the tubular plastic cover 119 to fit tightly around the narrowed regions 120*a*, 120*b* of these parts. Achieving a tight fit among these parts can protect the transparent structural tube 103 from solvents, greases and oils and automotive fluids, and fine gritty materials such as abrasive dusts and soil runoff. It is preferable in such a case that the top cap 110 and the handle cover 112 be made of a type of rubber that is resistant to solvents and fluids that the transparent tubular structure 103 is to be protected from.

Alternatively, the plastic cover 119 may be sealed from the region of the transparent structural tube 103 to be protected by means of gaskets or O-rings in lieu of narrowed regions 120*a*, 120*b* of the top cap 110 and handle cover 112.

Figure 8:
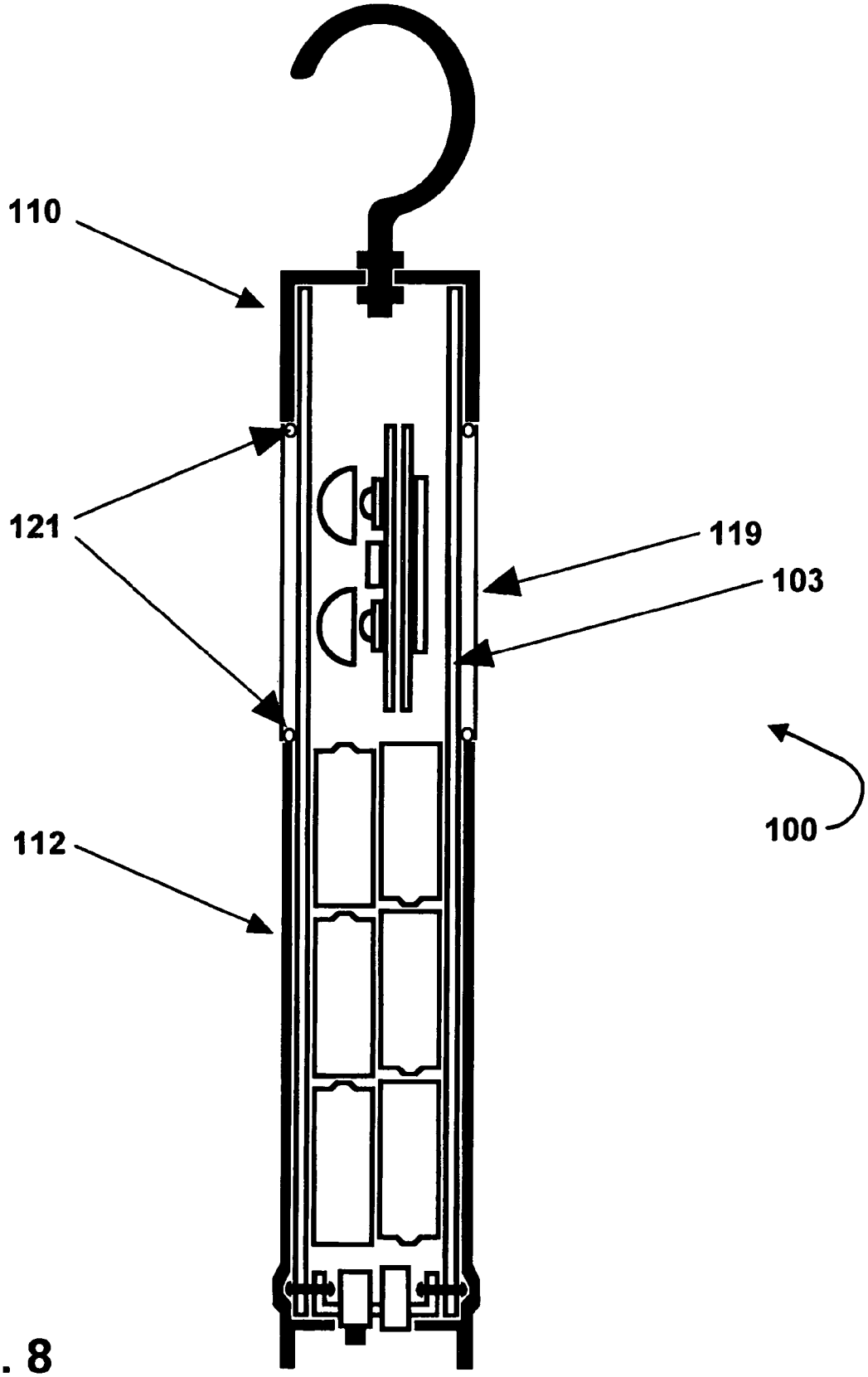
FIG. 8 is a cross sectional side view of a fifth example embodiment of a work light.

Referring to FIG. 8, the LED work light 100 of FIG. 6 has added to it O-rings 121 to seal from the environment the region of the transparent structural tube 103 that is covered by the plastic cover 119.

The O-rings 121 are shown as being fitted under the ends of the plastic cover 119 about the tube 103. Alternative arrangements are foreseeable, such as having the O-rings 121 compressed between the ends of the plastic cover 119 and the nearby edges of the top cap 110 and handle cover 112. Further alternatively, sealing means other than O-rings 121 may be used, such as gaskets or glue or a sealant such as caulk. Such a sealant may be removeable during replacement of the plastic cover 119, and may be for example a type of caulk that is easy to peel off. It is further foreseeable that gaskets or O-rings 119 may be combined with a sealant.

During assembly or reassembly after removing a worn tubular plastic cover 119, typically the tubular plastic cover 119 is placed over the narrowed region 120*b* of the handle 112, and afterwards the top cap 110 is installed, with the narrow region 120*a* being pushed into the tubular plastic cover 119.

Preferably, the top cap 110 and the handle cover 112 have overall width (diameter) greater than that of the tubular plastic cover 119 in order to minimize scratching and scraping of the tubular plastic cover 119 by any surfaces that the LED work light 700 is placed upon. The greater diameter holds the cover 119 off surfaces the LED work light 700 is placed upon.

Figure 9:
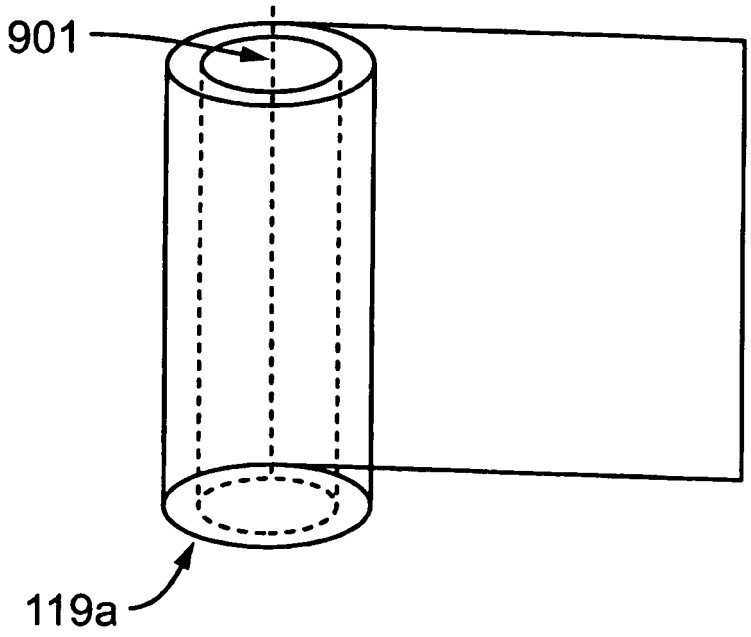
FIG. 9 is a diagrammatic illustration of an example embodiment of a transparent shield that may be used in a work light such as those described herein.

Referring to FIG. 9, the plastic cover 119 mentioned above may be in the form of a roll of plastic tape 119*a*. The tape roll 119*a* is preferably made transparent by use of a suitable plastic film and a suitable adhesive with few or no bubbles and voids. When the exposed outer surface of the tape roll 119*a* is scratched, scraped or worn, a small portion of the tape roll 119*a* may be peeled off and discarded. The tape roll 110*a* is shown as having a perforation 901 through all turns of the tape roll 119*a* to facilitate removal of one turn of the tape roll 119*a*.

Figure 10:
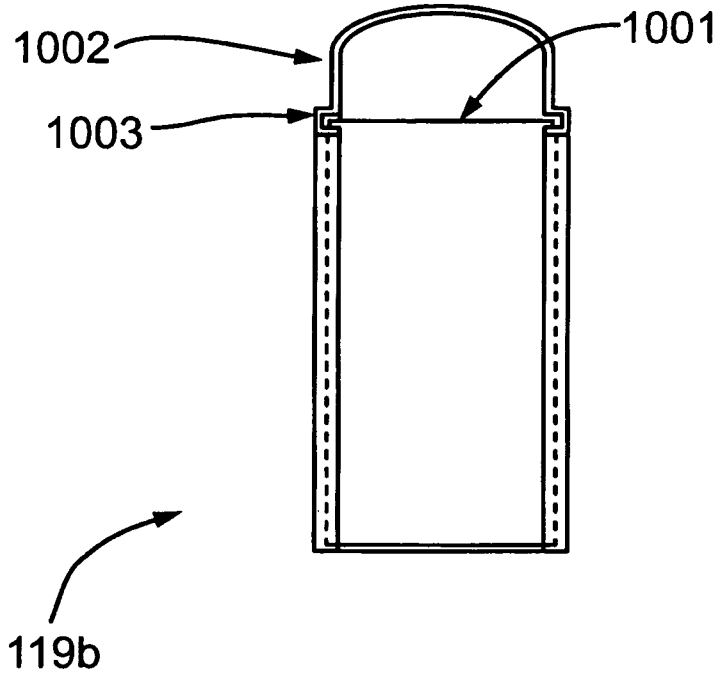
FIG. 10 is a frontal view of a second example embodiment of a shield that may be used in a work light such as those described herein.

Referring to FIG. 10, a further alternative protective cover 119*b* for tubular work lights can be made with a transparent window 1001 and a window holder 1002. The window holder 1002 is shown as being part of a non-circular tube so that it combines with the window 1001 to form the protective cover 119*b* in the form of a non-circular tube. The generally tubular form of the protective cover 119*b* permits it to be used over tubular work lights, whether or not such tubular work lights have a circular cross section. Such a tubular protective cover 119*b* can even be used over some non-tubular work lights, such as one having heatsinkable LEDs mounted onto a piece of channel stock or semicircular tube that is used both as a main structural member and as a heatsink.

The window 1001 is shown as fitting into grooves 1003 within the window holder 1002. Alternatively, the window holder 1002 may have latches or other means of holding the window 1001. Further alternatively, the window holder 1002 may be of a form other than a portion of a non-circular tube, such as latches that are attached to straps or to the work light being protected by the window 1001.

The window 1001 is shown as being a flat piece of transparent material such as plastic. The window 1001 may alternatively be curved or bent in shape to make the protective cover 119*b* more circular in shape. The window 1001 and the protective cover 119*b* may be made of polyethylene terephthalate or polycarbonate or another suitable material.

Figure 11:
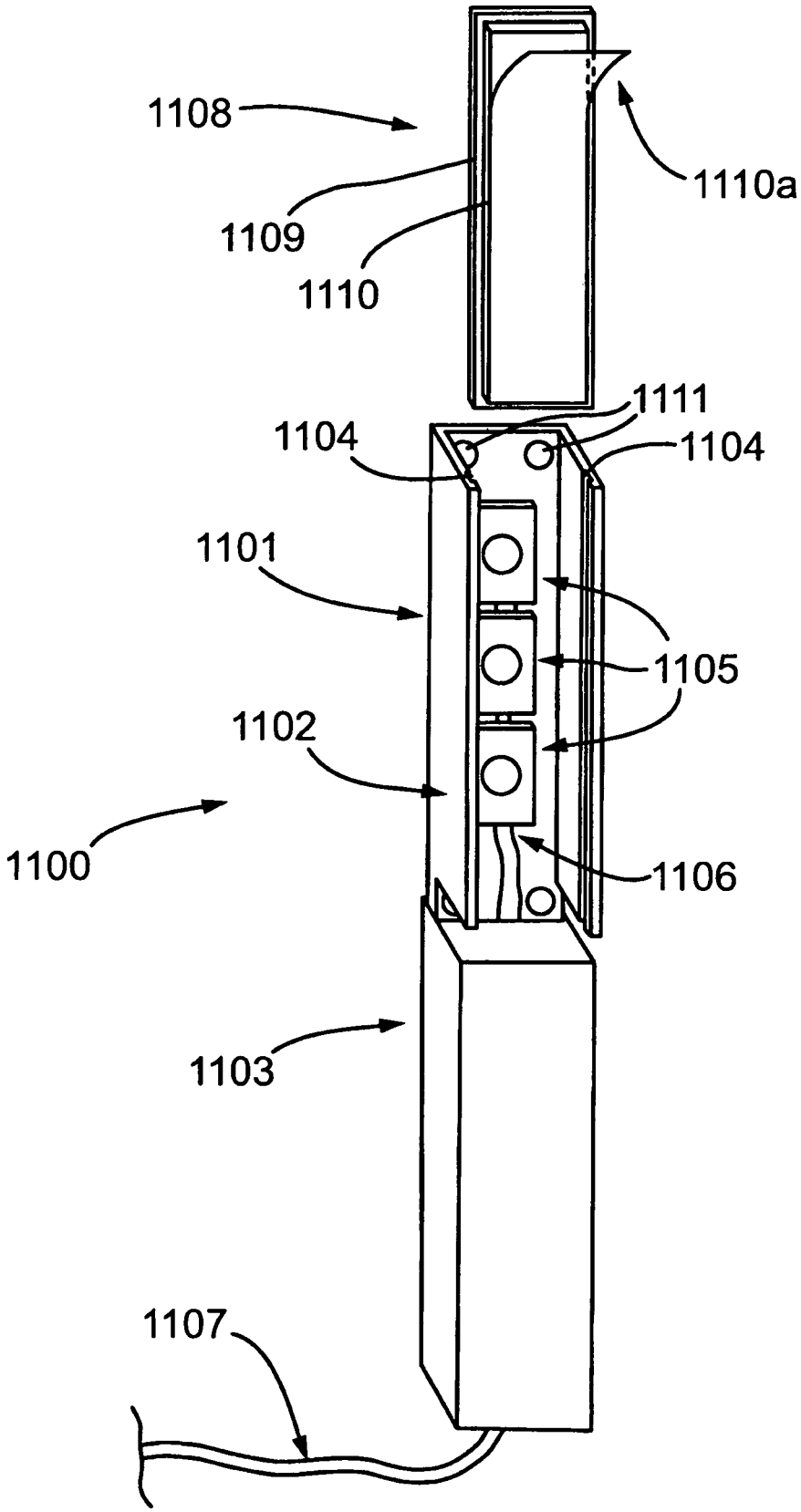
FIG. 11 is a partially exploded perspective view of a sixth example embodiment of a work light.

Referring to FIG. 11, an LED work light 1100 can be made with a metal channel 1101 as a main structural member, where the metal channel 1101 has grooves 1104 to accommodate a transparent protective shield 1108.

The metal channel 1101 is preferably made of aluminum or an aluminum alloy such as 6061 and can be used as a heatsink for the LEDs (not shown). Other heat conductive materials may be used. The LEDs would typically be placed under lenses 1105 and may be connected to wires 1106. Electrical power for the LEDs may be supplied from circuitry or through one or more resistors (not shown) within handle 1103. The handle 1103 is preferably made of or covered in rubber or plastic. The metal channel 1101 is shown as having its sides 1102 cut away from the portion surrounded by the handle 1103, although alternative arrangements are possible.

The LED work light 1100 is shown as having a cord 1107 for receiving electrical power from an external power source. The LED work light 1100 may have batteries that may be rechargeable. Any batteries would typically be located within the handle 1103. The handle 1103 would typically be hollow and comprise a removable or hinged cover (not shown) in order to accommodate any batteries.

The transparent shield 1108 is shown as having a base layer 1109 and a face layer 1110. The base layer 1109 is typically made of a high strength transparent plastic such as polymethylmethacrylate or polycarbonate, but may be made of an alternative material such as glass. The face layer 1110 may be a stack of separately removable thin transparent laminations that are preferably made of a suitable plastic film such as polyethylene terephthalate and which are attached to each other with a suitable adhesive. The outermost lamination 1110*a* may be peeled away and discarded after it is no longer suitably transparent due to being scratched, abraded, or marred by solvents during use of the LED work light 1100.

Other techniques may be used to protect transparent, light-transmitting parts of work lights with covers that are removable and replaceable. Some work lights protected in such a manner may have transparent covers or shields comprising multiple layers of a protective material that can be removed one layer at a time as the exposed surface becomes excessively scratched, abraded or otherwise worn. Some work lights protected in such a manner may have O-rings, gaskets or other sealing means associated with such transparent covers or shields. Sealing means may be rubber or otherwise suitable parts that also have other purposes, such as caps at either end of a tubular structure or any handle cover.

The LED work light 1100 is shown as including magnets 1111 to allow the LED work light 1100 to be attached to magnetic surfaces such as automobile hoods and other automobile frame and body surfaces. The magnets 1111 are shown as disposed inside the work light 1100, attached to the inner surface of the metal channel 1101. Some rare earth magnets can be powerful enough to allow an LED work light 1100 to be attached to automotive body surfaces despite being disposed on the inside surface of the rear side of the metal channel 1101 as shown.

Other mounting locations can be found for magnets 1111. For example, magnets 1111 may be placed in several locations within an LED work light such as the LED work light 1100 or 100 to allow the LED work light to be attached to a surface in more than one position. This allows adjustment of the direction that light from the LED work light 1100 is directed into. Alternatively, mounting means for magnets 1111 may allow movement of the magnets 1111. The magnets 1111 may be mounted in grooves that the magnets 1111 can slide within. The magnets 1111 may be mounted on the exterior surface of the LED work light 1111 to permit use of less expensive magnets 1111.

Figure 12:
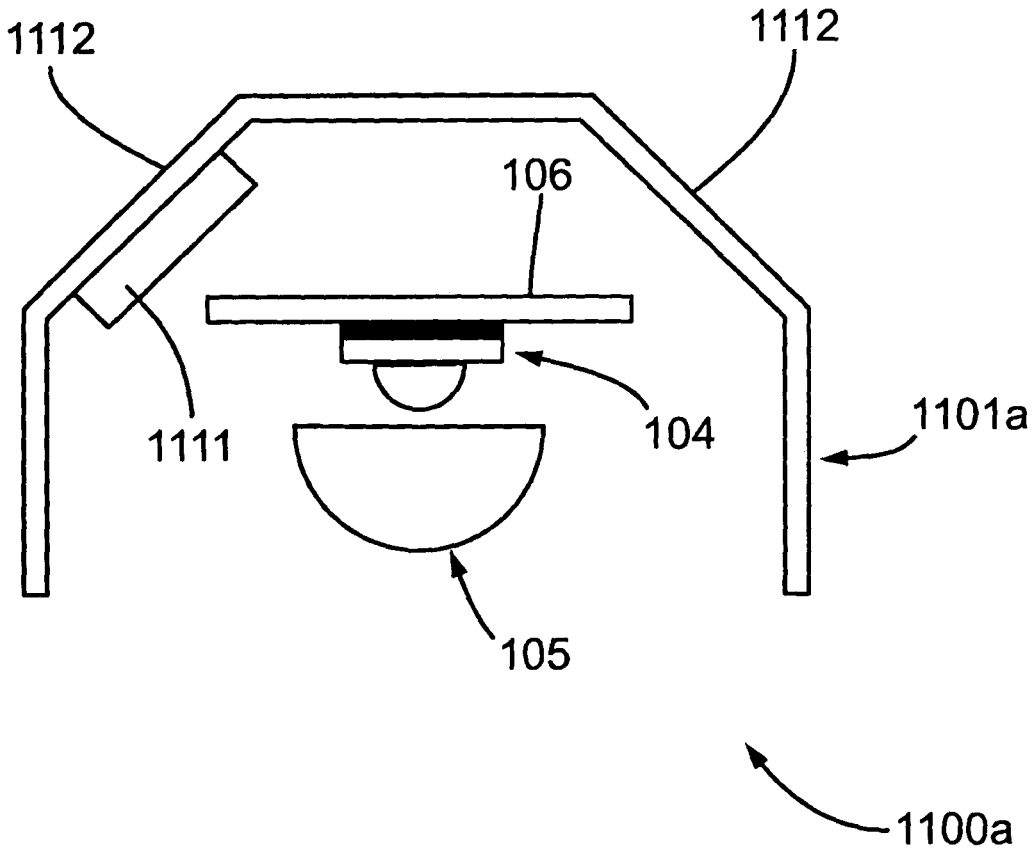
FIG. 12 is a cross sectional top view of an example variation of the sixth embodiment.

Referring to FIG. 12, an LED work light 1100*a* has a metal channel 1101*a* that has the shape of a partial octagon. With this shape and magnets 1111 disposed on at least one of the diagonal rear surfaces 1112 as shown, the LED work light 1100 can be attached to a magnetic surface with light being directed into a direction 45 degrees from perpendicular to the metal surface. This can be useful when attaching the LED work light 1100*a* to the underside of an automotive hood. Other shapes of LED work lights such as the LED work light 1100*a* may be found useful. Such shapes may include irregular octagons with the two diagonal rear surfaces 1112 having different angles from the direction that light is directed into, polygons other than octagons, circular tubular and oval tubular.

Figure 13:
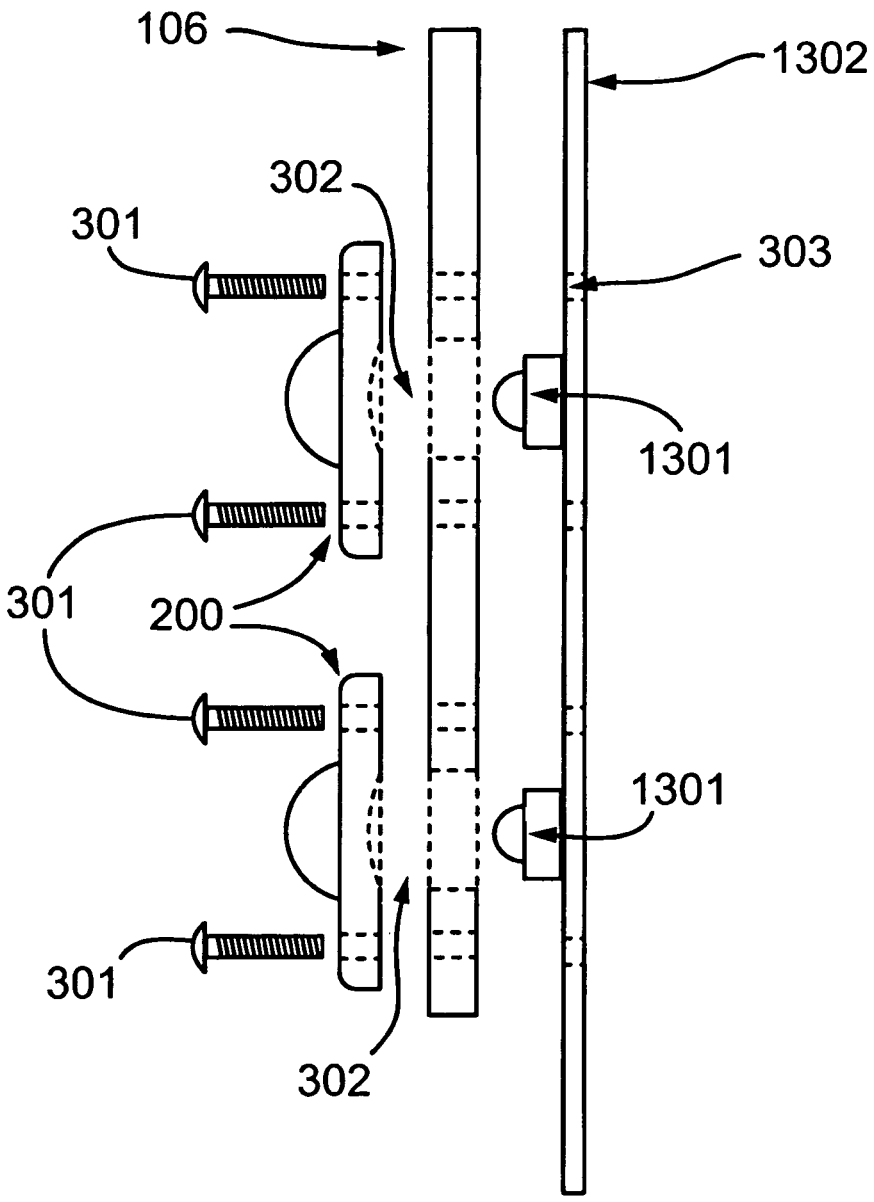
FIG. 13 is an exploded side view of a second example embodiment of an LED light source assembly that may be used in a work light such as those described herein.

Referring to FIG. 13, the assembly of FIG. 3 with only minor changes can accept the Cree Xlamp LED in lieu of the CL-652-8WN type LED.

Shown are the LED PCB 106, lenses 200, and screws 300. The LEDs 1301 are Cree Xlamp type LEDs or other LEDs that can be mounted onto a metal core printed circuit board, such as Lumileds "Luxeon Emitters". The LEDs 1301 are mounted onto a metal core printed circuit board 1302 that is used as a heatsink. The LED PCB 106 of FIG. 3 may be replaced with a heat conducting sheet or plate 106*a* other than a PCB, such as a metal such as aluminum, copper or brass, since it does not have any electrical function in this arrangement. The LED PCB 106 or sheet or plate 106*a* has holes to accommodate the protruding domes of the LEDs 1301 or to allow light from the LEDs 1301 to pass through. Any sheet or plate 106*a* would be used as a spacer between the lenses 200 and the metal core printed circuit board 1302.

Alternatively, the heatsink 108 of FIG. 3 may be used, especially if the LEDs 1301 are Lumileds "Luxeon Stars" or of another type that is mounted onto a heatsink and typically receives power from wires in lieu of being mounted to a printed circuit board. Further alternatively, the metal core printed circuit board 1302 can be mounted to an additional heatsinking means.

Figure 14:
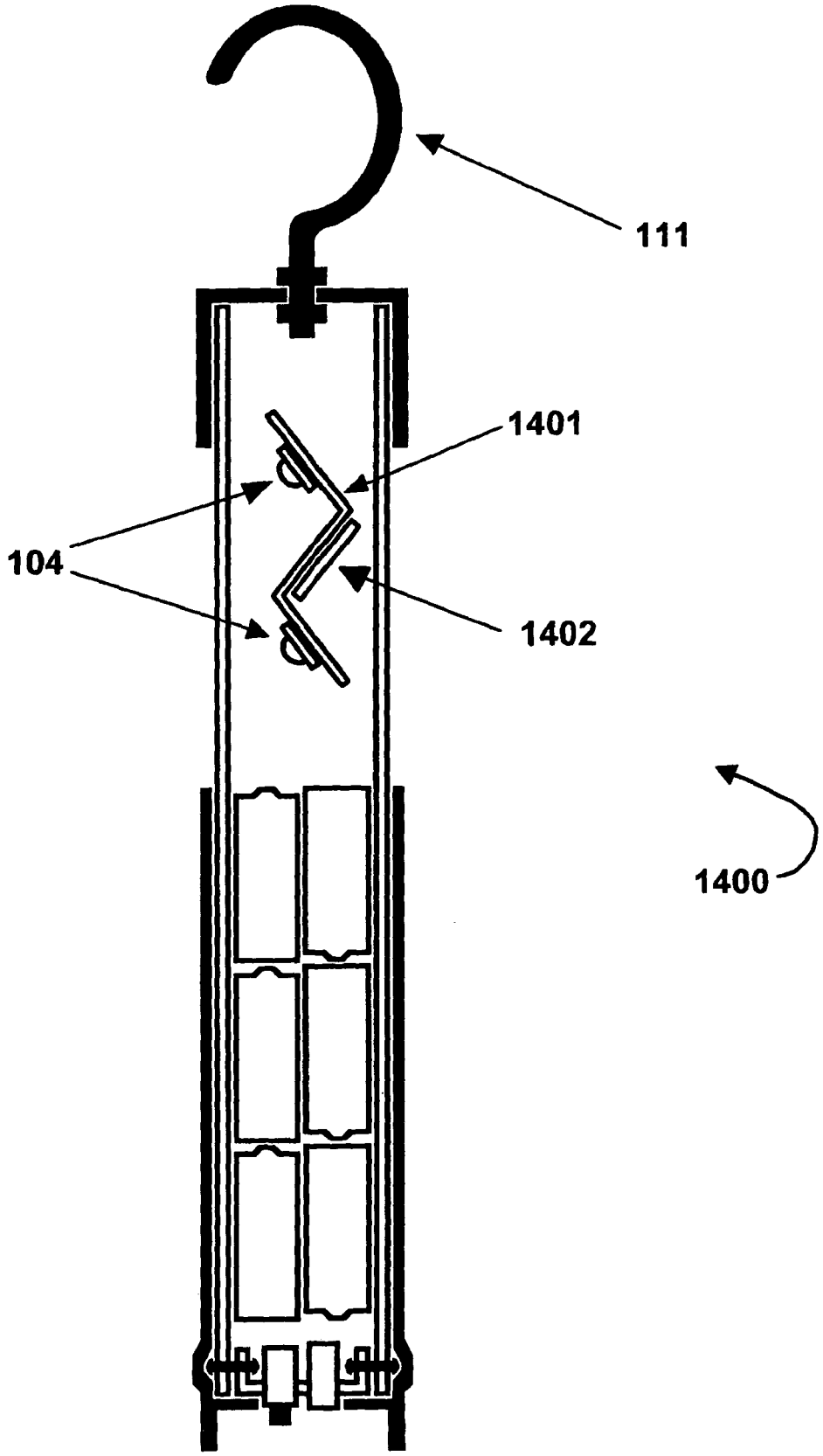
FIG. 14 is a cross sectional side view of a seventh example embodiment of a work light.

Referring to FIG. 14, a tubular LED work light 1400 is like that of the tubular work light 100 of FIG. 1; however, its LEDs 104 are mounted to direct their light output at an angle that is not perpendicular to the axis of the LED work light 1400.

This is shown as being accomplished by mounting the LEDs 104 to a zigzag-shaped heatsink 1400. Alternatively, LEDs 104 can be mounted to individually associated heatsinks that are mounted at an angle to the axis of the LED work light 1400 as opposed to in a manner in parallel with the axis of the LED work light 1400. Other methods for having an arrangement for light from LEDs to be directed at an angle from the axis of the LED work light 100 are possible. For example, the LEDs may be of a type that is typically mounted to a printed circuit board rather than to a heatsink, and such a printed circuit board may be mounted in an orientation at an angle to the axis of the LED work light 1400. Further alternatively, the LEDs 104 may be mounted with their axes perpendicular to the axis of the LED work light 1400 but one or more prisms or other optical means may be added to redirect the light at an angle from perpendicular to the axis of the LED work light 1400.

For simplicity, lenses are not shown; however, lenses are preferably included.

Circuitry 1402 is shown as provided since an LED work light 1400 typically requires circuitry 1402 such as a boost converter or a current regulator or one or more resistors in order for the LEDs 104 to receive a suitable magnitude of current. The circuitry 1402 is shown as mounted to the heatsink 1401, however, it may be located anywhere within the LED work light 1400.

An LED work light 1400 having light output directed from it at an angle from perpendicular to its axis can have an advantage over an LED work light whose light output is directed from it perpendicularly from its axis for some applications. For example, if the LED work light 1400 is hanging by its hook 111, then light will be directed from the LED work light 1400 at a downward angle. This may be especially useful if the LED work light 1400 is hanging from the tip of the hood of a car to illuminate the engine compartment of the car.

The optimum angle for light to be directed from the LED work light 1400 could be as little as 30 degrees or even less from parallel to the axis of the LED work light 1400 to optimally illuminate the engine compartment of a car if the LED work light 1400 is hanging vertically from the hood of the car whose engine compartment is being illuminated. However, an angle less parallel to the axis of the LED work light 1400 eases construction and makes the LED work light 1400 more suitable for handheld use. Meanwhile, having a wider beam of light from the LED work light 1400 enables adequate downward illumination from a vertically hanging LED work light 1400 even if the axis of the beam of light output is at an angle closer to perpendicular to the axis of the LED work light 1400. As a result, having the light output directed at a larger angle from the axis of the LED work light 1400, for example 60 degrees, may be found preferable.

The LEDs 104 may be not only mounted at an angle from being perpendicular to the axis of the LED work light 1400, but also that angle may be adjustable. However, it is currently preferred to have that angle being not adjustable to simplify construction of the LED work light 1400 and to minimize the chance of entry of spilled liquids into the LED work light 1400. Any angle adjustment means may have a provision such as magnets to allow adjustment through a liquidproof housing.

Other means may be found for achieving the beam of the LED work light 1400 being directed at a downward angle when the LED work light 1400 is hanging by its hook 111. For example, a weight can be added to the LED work light 1400 to cause it to hang at an angle. Alternatively, the LED work light 1400 may have a cord that has means of attachment to the hood of a car to cause the LED work light 1400 to hang less vertically. Further alternatively, an LED work light can have a head section with LEDs that has an axis that is at an angle with the axis of a handle section, and the handle section can have a hook.

Figure 15:
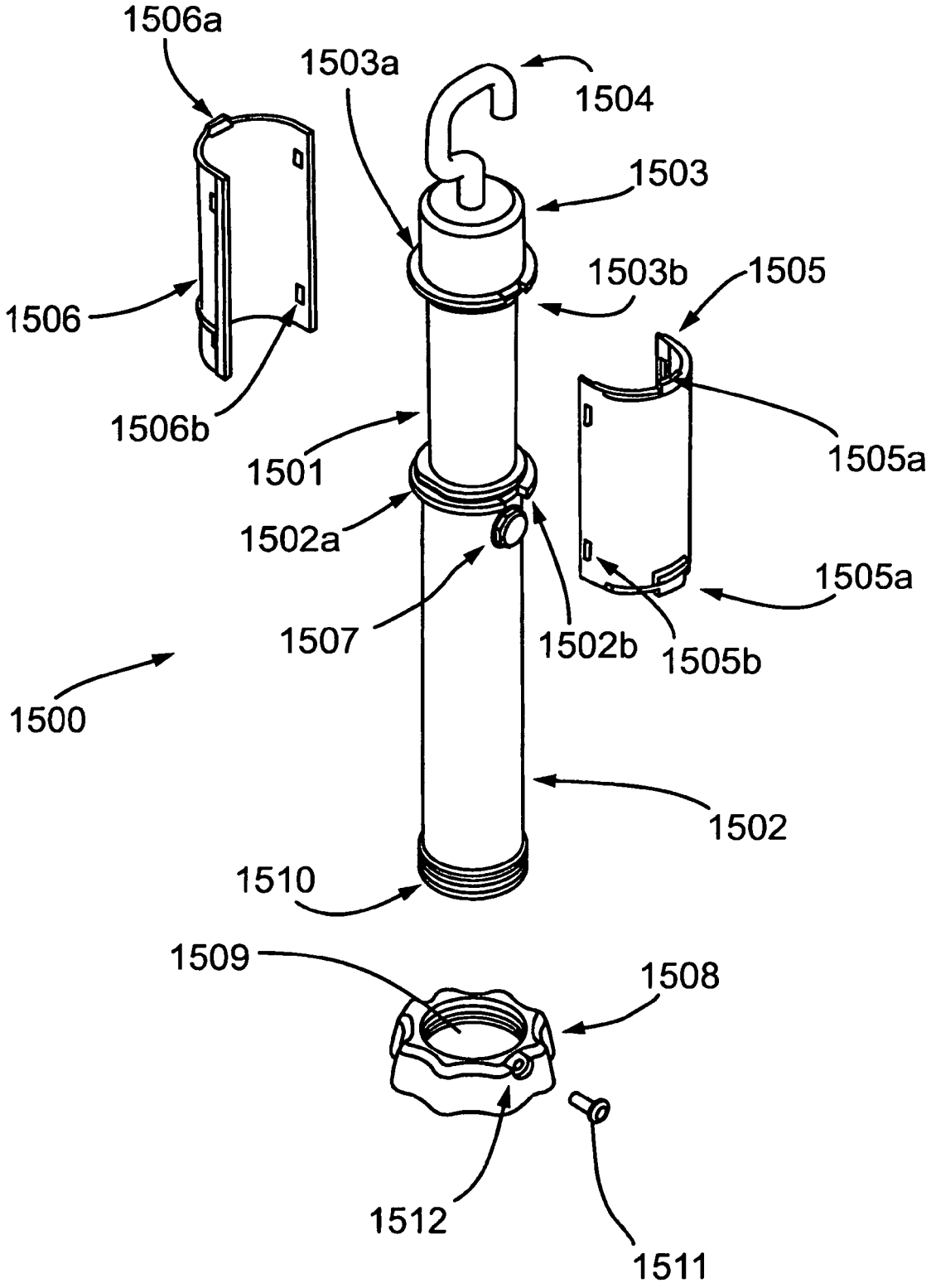
FIG. 15 is a partially exploded perspective view of an eighth example embodiment of a work light.

Referring to FIG. 15, LED work light 1500 is shown with certain removable parts separated from it for clarity. The LED work light is shown as comprising a structural transparent tube 1501, a plastic or rubber handle cover 1502, and a top end cap 1503 with a hook 1504. Removable parts of the LED work light 1500 shown separated from it are a threaded bottom end cap 1508, an overlapping transparent cover piece 1505, and an overlapped transparent cover piece 1506. Not shown are internal parts such as LEDs, batteries, and circuitry.

The threaded bottom end cap 1508 has threads 1509 so that the bottom end cap 1508 can be screwed onto threads 1510. As shown, the threads 1510 are on the handle cover 1502. The threads 1510 may be molded into the handle cover 1502, cut or machined from the handle cover 1502, or in a part added onto the handle cover 1502. Alternatively, the threads 1510 may be molded into, cut or machined from or added to the transparent structural tube 1501. The threaded bottom end cap 1508 is typically removed for battery replacement. A set screw hole 1512 is shown as being provided in the threaded bottom end cap 1508 to accommodate a set screw 1511. The set screw 1511 is typically provided to prevent accidental or unnecessary removal of the threaded bottom end cap 1508.

The bottom end cap 1508 can be sufficiently wide to permit the LED work light 1500 to stand vertically.

The handle cover 1502 is shown as having a flange 1502*a*, and the top end cap 1503 is shown as having an opposing flange 1503*b*, that the plastic cover pieces 1505, 1506 fit between. The handle cover 1502 is shown as having notches 1502*b*, and the top end cap 1503 is shown as having notches 1503*b*, that tabs 1505*a*, 1506*a* on the plastic cover pieces 1505, 1506 fit into.

Preferably the overlapped plastic cover piece 1506 has tabs 1506*b* that snap into holes 1505*b* in the overlapping plastic cover piece 1505 when the overlapping plastic cover piece 1505 is properly fitted over the overlapped plastic cover piece 1506. Alternatively, the overlapping plastic piece 1505 may have tabs fitting into corresponding holes on the overlapped plastic piece 1506. The overlapping plastic piece 1505 is transparent in order to allow light from the LEDs (not shown) to emerge from the LED work light 1500, and the overlapped plastic piece 1506 may also be transparent. The overlapping plastic piece 1505 and the overlapped plastic piece 1506 may be injection molded.

If the handle cover 1502 is made of rubber, then it can have a raised (or other indication of location) area 1507 that fits over a pushbutton switch (not shown). The pushbutton switch (not shown) may be fitted into or through a hole (not shown) in the transparent structural tube 1501.

Preferably as shown, the raised area 1507 of the handle cover 1502 and the accompanying pushbutton switch (not shown) are on the same side of the transparent structural tube

1501 that the overlapping plastic cover piece 1505 fits over. Alternatively, the pushbutton switch (not shown) and accompanying raised area 1507 of any rubber handle cover 1502 may be located elsewhere, such as on the same side of the transparent structural tube 1501 that the overlapped plastic cover piece 1506 fits over. Preferably the light from the LEDs (not shown) passes through overlapped plastic cover piece 1506 rather than the overlapping plastic cover piece 1505 because the overlapped plastic cover piece 1506 is typically smaller and farther from any surface that the LED work light 1500 is set horizontally upon and less likely to be scratched by such a surface.

Figure 16:
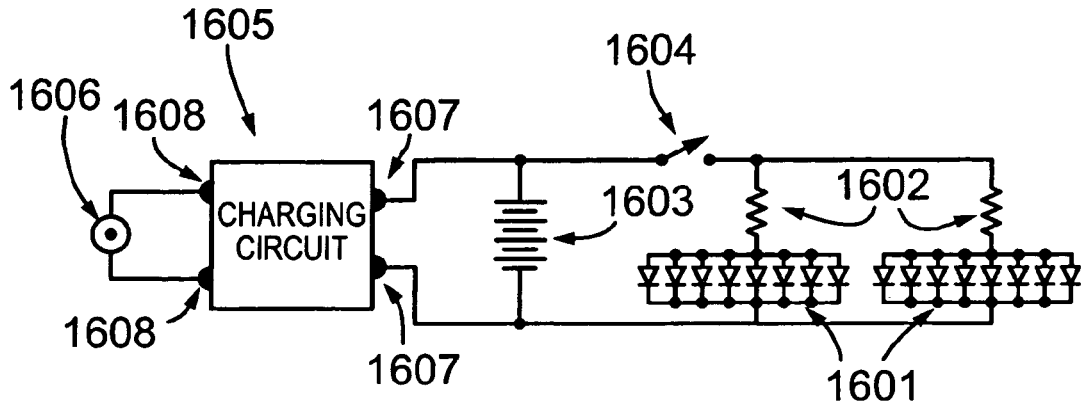
FIG. 16 is a first example circuit diagram of an embodiment of a circuit work light, suitable for use in embodiments of work lights described herein.

Referring to FIG. 16, a circuit diagram is shown as an example of a circuit of electrical components and connections in an LED work light having resistors 1602 to limit the magnitude of current flowing through LEDs 1601. The LEDs 1601 may be the LEDs 104 described above. Such an electrical arrangement may be suitable for work light embodiments described herein.

Two 8-chip LEDs 1601 are shown, and they may be a Citizen CL-652-8WN type suitable for parallel connection of their respective chips. Any number of LEDs 1601 may be used as an alternative to the two LEDs 1601 shown, typically with each having a respective dropping resistor 1602. LEDs 1601 may be of a type other than the 8-chip ones shown.

The shown 8-chip LEDs 1602 are shown as having their respective chips connected in parallel with each other. Alternatively, the chips of each of any multichip LED 1601 may be connected in series or in a series-parallel arrangement. Only one dropping resistor 1602 is shown as being associated with an associated LED 1602, and such an arrangement with any parallel or series-parallel connection of the chips of a multichip LED 1601 requires a multichip LED 1601 to have its chips having characteristics that permit such an arrangement. Otherwise, LED chips in a parallel or series-parallel arrangement may have excessively unequal current flow and this can cause unequal heating that can change conductivity of the LED chips in a way that exacerbates inequality of current magnitude among the LED chips. Alternatively, multichip LEDs 1601 may each have more than one associated dropping resistor 1602, for example a dropping resistor 1602 to individually limit current through each paralleled current path through a multichip LED 1601.

The LEDs 1601 are shown as receiving electrical power supplied by a battery 1603 through a switch 1604. Dropping resistors 1602 are shown as provided to limit the magnitude of current that flows through the LEDs 1601 to a value that permits sufficient life expectancy of the LEDs 1601 and that permits sufficient operation time of the battery 1603. Alternatively, LEDs 1601 and a battery 1603 may be of a type that permits satisfactory performance without the dropping resistors 1602, for example if the battery 1603 or the LEDs 1602 have substantial internal resistance or any built-in resistors or if the LEDs 1601 contain LED driver circuitry.

The battery 1603 is preferably rechargeable, in which case it would benefit from the shown charging circuit 1605 and the shown charging jack 1606 for the charging circuit 1605 to receive electrical power from an external power source (not shown). The external power source (not shown) is preferably only connected to the charging jack 1606 when the battery 1603 requires charging or recharging. The battery 1603 is preferably replaceable, but may alternatively be permanently installed. Alternatively to a rechargeable battery 1603, the battery 1603 may be non-rechargeable.

The charging circuit 1605 is shown as having two input terminals 1608 and two output terminals 1607. Alternative arrangements, for example, may have only three terminals with one of the output terminals 1607 and one of the input terminals 1608 consolidated into a common terminal (not shown) if the specific type of charging circuit 1605 permits such an arrangement.

The charging circuit 1605 may include charge status indication such as indicator LEDs (not shown).

The switch 1604 is preferably a pushbutton switch that is usable as a push-on-push-off type, also known as an alternate action type. Any such pushbutton switch 1604 may have ability to be used as a momentary pushbutton switch by pushing its button only partially inward.

Figure 17:
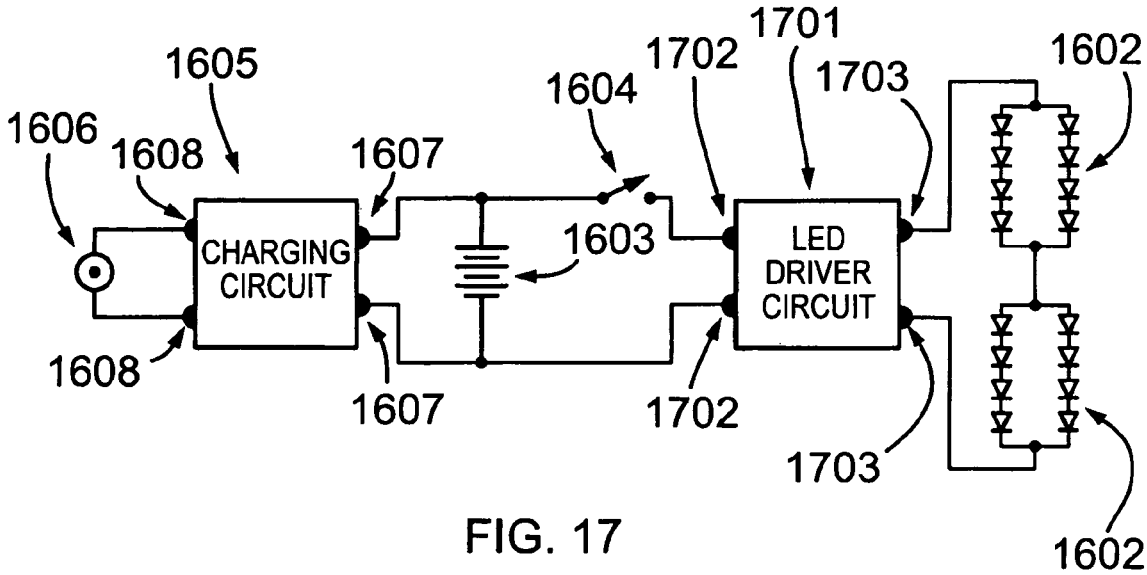
FIG. 17 is a second example circuit diagram of an embodiment of a circuit work light, suitable for use in embodiments of work lights described herein.

Referring to FIG. 17, an electrical arrangement is shown for an LED work light having LEDs 1602 receiving electrical power from an LED driver circuit 1701 that provides current through the LEDs 1602 that is limited in magnitude. This arrangement is shown as having a battery 1603, charging circuit 1605 with input terminals 1608 and output terminals 1607, and a charging jack in the same manner as the electrical arrangement shown in FIG. 16.

Two 8-chip LEDs 1602 are shown, although with their chips connected in a series-parallel arrangement and the two LEDs 1602 are shown as being connected in series with each other. Numerous alternative arrangements of series connection, parallel connection and series-parallel connection are possible, and the number of LEDs 1602 may be other than two, and the LEDs 1602 may be of a type other than a type having 8 chips. One alternative example is that the LEDs 1602 may be single chip LEDs. Further alternatively, the LEDs 1602 may be of a multichip type having only two external terminals and connections of their respective chips of each multichip LED 1602 being internal, such as Lumileds Luxeon V LEDs.

The LED driver circuit 1701 may be a boost converter whose output current is limited in magnitude, such as any of the boost converter circuits shown as being used for LED inspection lamps in US Patent Application 20050007777 previously mentioned and incorporated by reference herein. The LED driver circuit 1701 may alternatively be a switching current regulator such as one shown in US Patent Application 20050265035 previously mentioned and incorporated by reference herein. Further alternatively, other types of an LED driver circuit 1701 may be used, such as, for example, a "linear" (non-switching) current regulator.

As shown, one LED driver circuit is provided to supply electrical power to the LEDs 1602 with current sufficiently limited in magnitude. Alternatively, more than one LED driver circuit 1701 may be used, for example each LED 1701 being associated with a respective separate LED driver circuit 1701.

Figure 18:
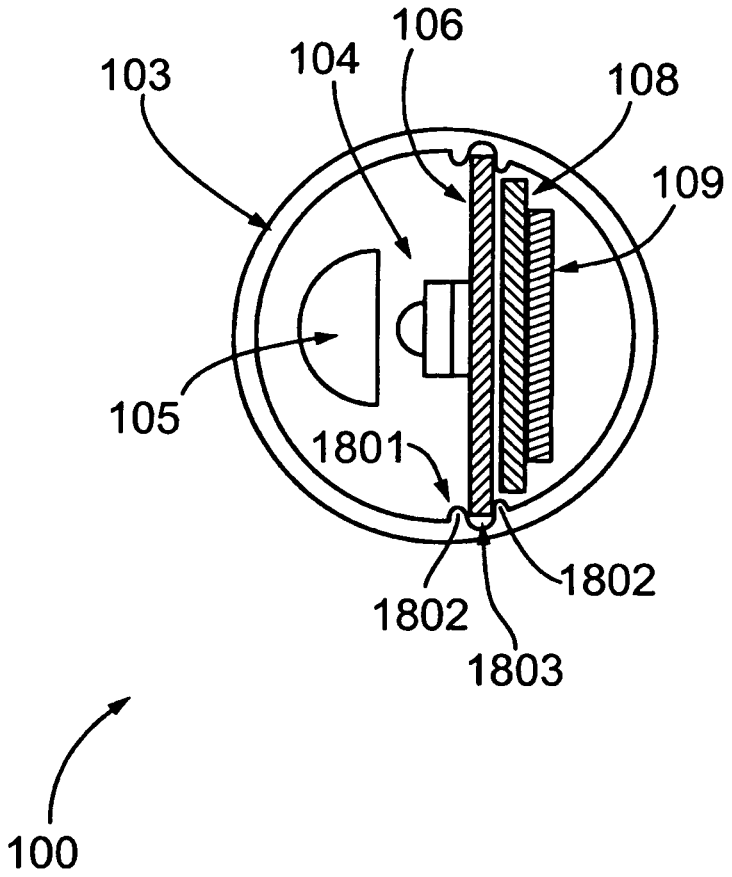
FIG. 18 is a cross-sectional end view of an example head section of the work light embodiment of FIG. 1.

Referring to FIG. 18, a cross sectional end view of the head section of the tubular LED work light 100 of FIG. 1 is shown. Shown is the structural transparent tube 103, one of the LEDs 104, one of the lenses 105, the LED board 106, the heatsink 108 and the circuitry 109.

Further shown in the structural tube 103 is a holding means 1801 comprising two ridges 1802 extending from the tube 103 into an interior of the tube 103 and comprising a groove 1803. As shown, the LED board 106 slides into the board holding means 1801. The groove 1803 extends into the tube 103 itself. The groove 1803 may be used alone or in conjunction with the ridges 1802. The board holding means 1801 may alternatively hold the heatsink 108 in lieu of the LED board 106. Further alternatively, holding means such as the board holding means 1801 may be provided for both the LED board 106 and the heatsink 108. For example, both the LED board 108 and the heatsink 106 may be placed into the same groove 1803 or separate grooves 1803.

Figure 19:
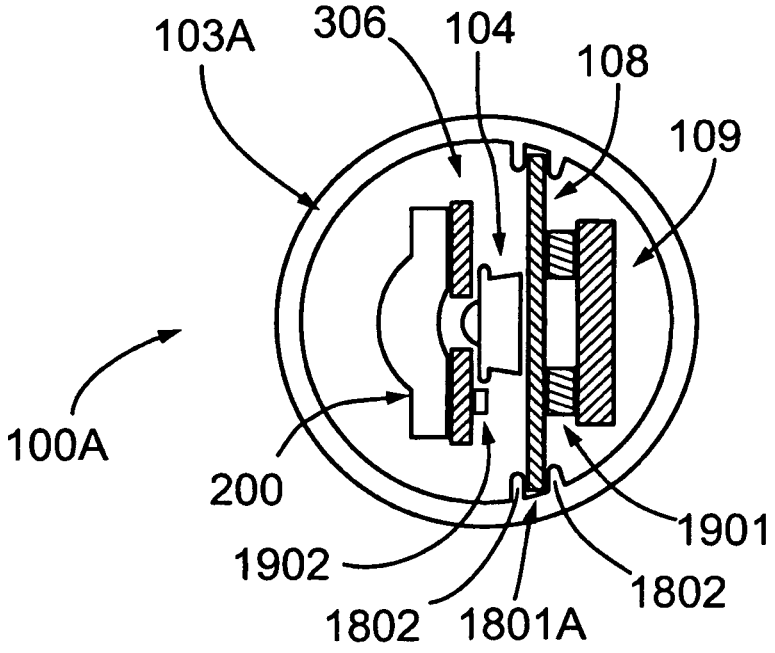
FIG. 19 is a cross-sectional end view of an alternative example head section.

Referring to FIG. 19, a cross section of a tubular LED work light 100A that is similar to the tubular LED work light 100 of FIGS. 1 and 18 is shown. As in FIG. 18, the section is through the head section and perpendicular to the axis of the structural transparent tube 103A. The structural transparent tube 103A differs from the above described structural transparent tube 103 by having board holding means 1801A shown as comprising only two ridges 1802.

The LED work light 100A differs from the LED work light 100 by having the assembly of FIG. 3 that is currently preferred when the LEDs 104 are to be Citizen CL-652-8WN. Shown is the heatsink 108, one of the LEDs 104, the LED board 306, and one of the lenses 200 shown in FIG. 3 and accordingly described above. Circuitry 109 is also shown, and in the LED work light 100A is preferably a battery charging circuit. The current limiting means typically required by each LED 104 is shown in the LED work light 100A as being a resistor 1902 mounted to the LED board 306 rather than the circuitry 109.

The ridges 1802 may extend longitudinally for the length of the tube 103. Alternatively, a plurality of pairs of ridges 1802 may be spaced apart along the length of the tube 103 to hold the light source assembly in place at certain locations. The holding means 1801 holds the light assembly from rotational and lateral movement with the tube 103. The light assembly may be held in place longitudinally by sandwiching the light assembly and other internal components of the work light between the top cap and end cap. Alternatively or in addition, the light assembly may be held longitudinally by other techniques such as for example glue or another adhesive. The holding means 1801 are examples only. Many other forms of holding means my be utilized to hold the light source assembly in place, such as for example glue or another adhesive, or circular holders above and below the light source assembly, for example respectively forming part of the top cap and sandwiched between the assembly and the battery.

Figure 20:
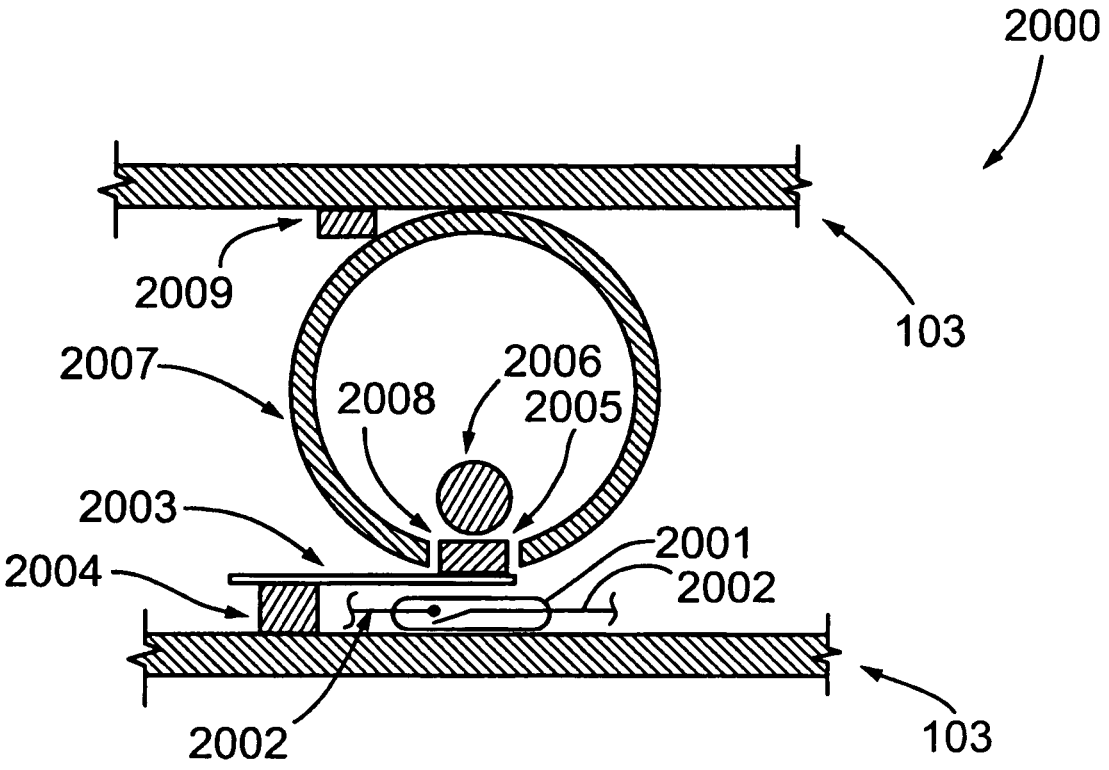
FIG. 20 is a side cross-section of a portion of a tubular work light illustrating an example embodiment of a position sensing switch.

Referring to FIG. 20, a position sensing switching means 2000 can be useful in LED work lights generally, including for example those described herein. The position sensing switching means 2000 is mounted within a structural tube 103 such as that of the tubular LED work light 100 shown in FIGS. 1 and 18 and described above. The position sensing switching means 2000 may be arranged so that an LED work light would be switched off by placing it in a particular position, such as horizontally and facing upwards.

The position sensing switching means 2000 is shown as comprising a magnetic reed switch 2001 with leads 2002, a leaf spring 2003 with a mounting block 2004, a first magnet 2005, a second magnet 2009, a small spherical weight 2006, and a hollow sphere 2007 having a hole 2008. The leaf spring 2003 is shown as being mounted to the mounting block 2004 which is shown as being mounted to the housing of the LED work light, in this instance being the above-described structural tube 103.

If an LED work light having the position sensing switching means is placed in the position intended to cause actuation of the reed switch 2001, the small spherical weight rests on the magnet 2005 and pushes the magnet 2005 towards the magnetic reed switch 2001. This results in the magnetic reed switch 2001 actuating. If the LED work light is in any other position, then the small spherical weight 2006 rolls into a location that does not push the magnet 2005 towards the magnetic reed switch 2001. This can be found useful to make an LED work light that can be switched off by placing it into a particular position and switching it on by holding it in any other position.

Optionally, a second magnet 2009 can be provided and the small spherical weight 2006 can be magnetic. In such an optional arrangement, an LED work light having this arrangement can be tilted into a position that causes the small spherical weight 2006 to stick to a position in the hollow sphere 2007 near the second magnet 2009. This can permit an LED work light having such an arrangement to be placed in any position without actuating the magnetic reed switch 2001. This may be found useful should a user of such an LED work light want to use it in a position normally intended to turn off such an LED work light. After such use, such an LED work light can be tapped or shaken to cause the small spherical weight 2006 to be released from the position near the second magnet 2009. This provides a releasably overridable position sensing switch which may be overridden for use in a position that would otherwise turn the position switch off and such override is releasable to return the switch to its normal position sensing operation.

A magnetic reed switch 2001 may be particularly useful in work lights to be used in environments having flammable gases, vapors, or dusts since any sparks resulting from switching would be contained within the magnetic reed switch 2001 and thereby isolated from such gases, vapors or dusts. The switch contacts may be further contained and isolated from the environment in which the work light is used by sealing the work light to prevent entry of flammable material into the structural tube 103.

Figure 21:
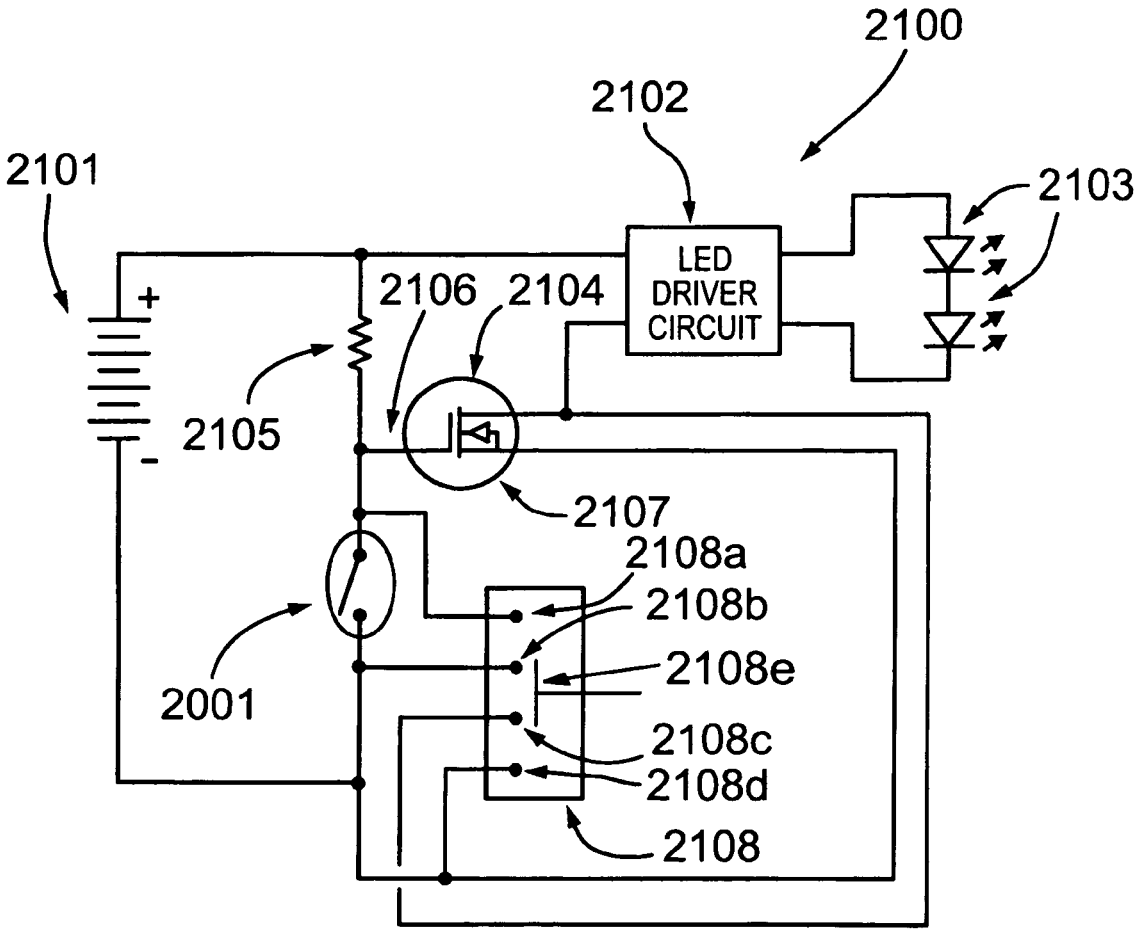
FIG. 21 is an example circuit employing a position sensing switch; the circuit may be used in work light such as, for example, the work light embodiments described herein.

Referring to FIG. 21, a magnetic reed switch 2001 is normally open and is used in an electrical circuit 2100 which may be utilized in a work light, such as for example, the embodiments of work light described herein where its actuation results in LEDs 2103 in such an arrangement to be turned off. Numerous alternative arrangements are known to able to achieve such a result.

A battery 2101 is shown as being provided as a source of electrical power for an LED driver circuit 2102, which provides electrical power to the LEDs 2103. The LED driver circuit 2104 is shown as being switched by an N-channel enhancement mode MOSFET type transistor 2104. A resistor 2105 normally causes the gate terminal 2106 of the MOSFET 2104 to be at essentially the same potential as the positive terminal of the battery 2101, while the source terminal of the MOSFET 2104 is connected to the negative terminal of the battery 2101, and this causes the MOSFET 2104 to be conductive and allow the LED driver circuit 2102 to receive power from the battery 2101.

If the magnetic reed switch 2101 is closed, then the gate terminal 2106 is shorted to the source terminal 2107, causing the MOSFET 2104 to become nonconductive, resulting in the LED driver circuit 2102 not receiving power from the battery 2101.

Figure 22:
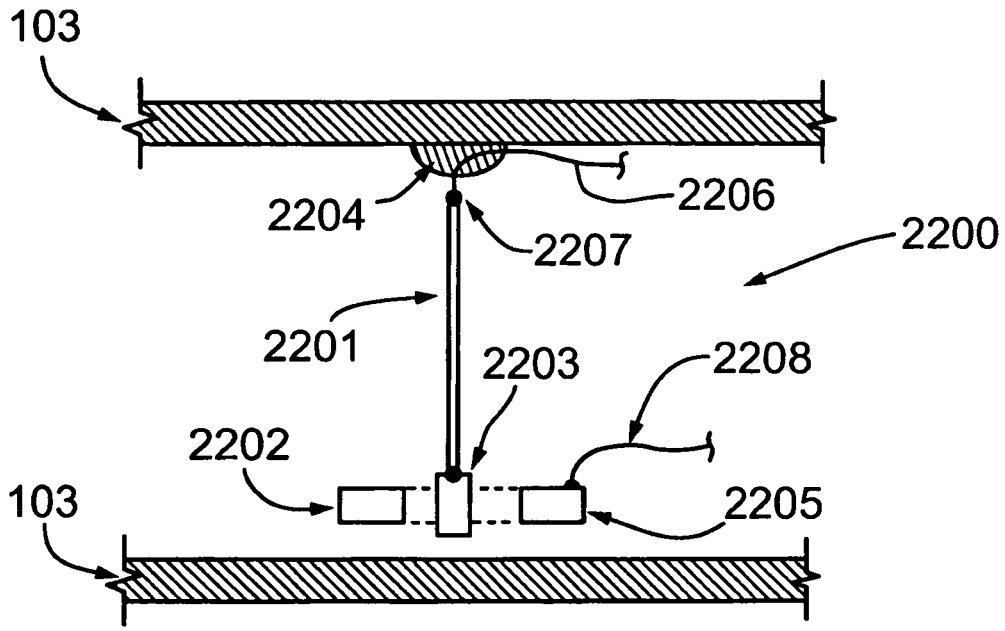
FIG. 22 is a side cross-section of a portion of a tubular work light illustrating an alternate example embodiment of a position sensing switch.

Referring to FIG. 22, a tilt switch 2200 can be mounted within an LED work light housing such as the above-described structural tube 103. The tilt switch 2200 is an example of a position sensing switch that is open when it is in a particular position and closed when it is in most other positions. It is possible for such a position sensing switch to be used to have a work light operating when it is in most positions and off when it is in a particular position. As a result, it is possible for such a position sensing switch such as the tilt switch 2200 to be used as the main switch of an LED work light such as the LED work light 100 shown in FIGS. 1 and 18 and described above.

The tilt switch 2200 is shown as comprising a pendulum formed by a conductive rod 2202, a conductive weight 2203, and a suitable joint between the conductive rod 2202 and a first wire 2206, and mounting means 2204 such as glue. The tilt switch 2200 is further comprising a conductive washer 2205 which is contacted by the conductive weight 2203 when the tilt switch 2200 is not in or nearly in a specific position. A second wire 2208 is also shown. The first wire 2206 and the second wire 2208 are leads of the tilt switch 2200.

Optionally provided with a position sensing switch such as the magnetic reed switch 2101 is a bypass switch 2108. The bypass switch 2108 is shown as being a 3-position slide switch with contacts 2108*a*, 2108*b*, 2108*c*, 2108*d* and a movable contact 2108*e*. The movable contact can be moved to a position that connects the contact 2108*a* to the contact 2108*b*, resulting in the slide switch 2108 shorting the magnetic reed switch 2001 and causing the LEDs 2103 to not receive power regardless of the status of the magnetic reed switch 2101. The movable contact 2108*e* can be moved to a position that connects the contact 2108*c* to the contact 2108*d*, to bypass the MOSFET 2104 so that the LEDs 2103 receive power regardless of the status of the magnetic reed switch 2001. Such an arrangement or alternative arrangements with similar results can be useful in an LED work light such as any of the LED work lights described herein to bypass a position sensing switch so that such an LED work light can be turned on or off regardless of its position. Such an arrangement provides an alternative releasably overridable position sensing switch. Other forms of such switches are possible.

The above specification is to provide examples of the present invention. Features and functions of one embodiment may be utilized in other embodiments. Not all combinations of features and functions have been described herein.

It will be understood by those skilled in the art that this description is made with reference to the preferred embodiment and that it is possible to make other embodiments employing the principles of the invention which fall within its spirit and scope as defined by the following claims.

The content of U.S. patent application Ser. No. 11/083,086 filed 18 Mar. 2005 and published as US 2005/0265035 A1 on publication date 1 Dec. 2005, and U.S. patent application No. 60/521,240, filed 18 Mar. 2004, U.S. patent application No. 60/521,680 filed 16 Jun. 2004, U.S. patent application No. 60/521,689 filed 17 Jun. 2004, U.S. patent application No. 60/521,738 filed 28 Jun. 2004, and U.S. patent application No. 60/521,888 filed 17 Jul. 2004 is hereby incorporated by reference into the Detailed Description hereof.

What is claimed is:

1. A light emitting diode (LED) work light comprising:

a handle section, a head section and a structural tube extending through both the head section and the handle section, a plurality of LEDs mounted in the tube within the head section, power receiving means for the plurality of LEDs to receive electrical power, an LED board in the tube within the head section having a first side and a second side, the second side defining a plane, the LED board including a respective hole for each LED of the plurality of LEDs, each hole being a channel extending from the first side of the LED board to the plane of the second side, the plurality of LEDs being attached to the first side of the LED board such that a dome of each LED of the plurality of LEDs projects forward through the respective channel of the LED and extends past the plane of the second side of the LED board, wherein each LED fills an entirety of the respective channel for the LED, each LED of the plurality of LEDs being associated with a respective lens, each lens mounted onto the second side of the LED board in front of the associated LED, the second side of the LED board opposing the first side of the LED board, and a heatsink disposed behind both the plurality of LEDs and the LED board in the tube within the head section, wherein the LED board is fastened to the heatsink in a manner that achieves thermal contact by direct contact between a base of each LED and the heatsink and wherein the structural tube is transparent in the head section for light from the plurality of LEDs to emit from the work light, wherein the base of each LED projects rearward from the first side of the LED board to directly contact the heatsink such that a space is defined between the LED board and the heatsink such that the LED board does not directly contact the heatsink when fastened thereto.

2. The LED work light of claim 1 wherein the heatsink is a heat conducting sheet.

3. The LED work light of claim 1 wherein the heatsink is a metal core printed circuit board.

4. The LED work light of claim 1 wherein the LED board is a printed circuit board.

5. The LED work light of claim 1 wherein the heatsink, LED board and plurality of LEDs form a light assembly, and the LED work light further comprising board holding means to rotationally and laterally hold the light assembly to the structural tube.

6. The LED work light of claim 2 further comprising board holding means extending longitudinally along the structural tube to rotationally and laterally hold the heatsink to the structural tube.

7. The LED work light of claim 3 further comprising board holding means extending longitudinally along the structural tube to rotationally and laterally hold the heatsink to the structural tube.

8. The LED work light of claim 1 wherein the LED board further comprises electrical connections for powering each LED.

9. A light emitting diode (LED) work light comprising a handle section, a head section and a structural tube extending through both the head section and the handle section, at least one LED mounted in the tube within the head section, power receiving means for the at least one LED to receive electrical power, an LED board in the tube within the head section having a first side and a second side, the second side defining a plane, with the at least one LED being attached to the LED board, and a heatsink in the tube within the head section; wherein the LED board is fastened to the heatsink in a manner that achieves direct thermal contact between a base of each LED and the heatsink; wherein the structural tube is transparent in the head section for light from the at least one LED to emit from the work light; wherein the LED board comprises a hole for each LED of the at least one LED, each hole being a channel extending from the first side of the LED board to the plane of the second side, wherein a dome of each LED of the at least one LED projects forward through the respective channel of the LED board and extends past the plane of the second side of the LED board, wherein each one of the at least one LED is mounted to the first side of the LED board, wherein each LED fills an entirety of the respective channel for the LED, wherein the work light further comprises a respective lens for each LED of the at least one LED, with each lens mounted to the second side of the LED board, forward of the dome; and wherein the heatsink is disposed behind both the LED board and the at least one LED; wherein the base of each LED projects rearward from the first side of the LED board to directly contact the heatsink such that a space is defined between the LED board and the heatsink such that the LED board does not directly contact the heatsink when fastened thereto.

* * * * *